United States Patent [19]

Saito

[11] Patent Number: 4,961,655

[45] Date of Patent: Oct. 9, 1990

[54] PRINTER WITH AUTOMATIC TYPE WHEEL EXCHANGING

[75] Inventor: Hideo Saito, Mitsukaido, Japan

[73] Assignee: Canon Kabushiki Kaisha, Tokyo, Japan

[21] Appl. No.: 240,445

[22] Filed: Sep. 2, 1988

Related U.S. Application Data

[63] Continuation of Ser. No. 896,056, Aug. 13, 1986, abandoned.

[30] Foreign Application Priority Data

Aug. 14, 1985 [JP] Japan ..... 60-177754
Oct. 1, 1985 [JP] Japan ..... 60-216126

[51] Int. Cl.[5] ..... B41J 1/30
[52] U.S. Cl. ..... 400/171; 400/144.2
[58] Field of Search ..... 400/82, 144.2, 149, 400/150, 151, 151.1, 171, 174, 175

[56] References Cited

U.S. PATENT DOCUMENTS

| | | | |
|---|---|---|---|
| 4,026,403 | 5/1977 | Inose et al. | 400/144.2 |
| 4,197,022 | 4/1980 | Dollenmayer | 400/149 |
| 4,281,938 | 8/1981 | Phillips | 400/171 |
| 4,289,412 | 9/1981 | Dollenmayer | 400/171 |
| 4,307,968 | 12/1981 | Habich et al. | 400/171 |
| 4,357,115 | 11/1982 | Or | 400/144.2 |
| 4,494,884 | 1/1985 | Lowell | 400/82 |

FOREIGN PATENT DOCUMENTS

| | | | |
|---|---|---|---|
| 3406616 | 8/1984 | Fed. Rep. of Germany | 400/175 |
| 33149 | 2/1894 | Japan | 400/171 |
| 91674 | 7/1980 | Japan | 400/175 |
| 36454 | 3/1983 | Japan | 400/171 |
| 58-39464 | 3/1983 | Japan | 400/171 |
| 201656 | 11/1983 | Japan | 400/149 |
| 2120978 | 12/1983 | United Kingdom | 400/171 |
| 2154513 | 9/1985 | United Kingdom | 400/171 |

OTHER PUBLICATIONS

C. D. Bleau; "Automatic Print Wheel Loader"; *IBM Tech. Disc. Bull.;* vol. 18, No. 10, pp. 3350–3351; Mar. 1976.

R. E. Hunt; "Multiple Print Wheel Font Changing Apparatus"; IBM Tech. Disc. Bull.; vol. 22, No. 10, pp. 4349–4350; Mar. 1980.

A. M. Robert et al.; "Impact Printer w/Cassette Daisy Wheel Type Font"; *IBM Technical Disclosure Bulletin;* vol. 22, No. 1, pp. 1–3; Jun. 1979.

*Primary Examiner*—David A. Wiecking
*Attorney, Agent, or Firm*—Fitzpatrick, Cella, Harper & Scinto

[57] ABSTRACT

A printer of the automatic type wheel exchanging type comprises a long platen to support a print sheet and a carriage guided so as to be reciprocated along the platen. This carriage includes: a wheel motor for detachably coupling the daisy type wheel having types in the peripheral portions of a number of radially projected spokes and for rotating this wheel; a print hammer for pressing the type of the type wheel coupled with the drive shaft of the wheel motor onto the print sheet; an enclosing box which can enclose a plurality of such type wheels; and a type wheel exchanging device for exchanging the type wheel coupled with the wheel motor for another type wheel in the enclosing box, and for coupling this wheel with the wheel motor. The enclosing box is movable in the direction almost perpendicular to the moving direction of the carriage so as to select a desired one of the type wheels in the enclosing box. The type wheel at the detachable position and the type wheels in the enclosing box overlap each other. With this small-sized, light-weight, and simple type wheel exchanging constitution, the type wheel can be efficiently and promptly exchanged and various kinds of characters can be printed at a high speed.

15 Claims, 30 Drawing Sheets

PRINTER WITH AUTOMATIC TYPE WHEEL EXCHANGING

This application is a continuation-in-part of application Ser. No. 896,056 filed Aug. 13, 1986, now abandoned.

FIELD OF THE INVENTION

The present invention relates to a printer in which a type wheel having a type at each end of the radially projected spokes is automatically exchanged and the printing operation is performed.

DISCLOSURE OF RELATED ART

In general, in typewriters, many impact type printers using type elements having matrix types are used because the printing quality is excellent and carbon copies can be simultaneously obtained and the like. However, such impact type printers using type elements have a limitation in terms of the printing of a variety of characters.

To eliminate this limitation, many methods of enabling various kinds of characters to be printed have conventionally been proposed. For example, according to U.S. Pat. No. 4,026,403 (Background art 1), a plurality of daisy wheels are combined like a doughnut and arranged beside the side surface of the printer casing, and when the type wheel is exchanged, the carriage is moved to the side surface of the casing, thereby exchanging the wheel at that position.

On the other hand, according to U.S. Pat. No. 4,281,938 (Background art 2), the rotary box in which a plurality of daisy wheels are held is arranged out of the printing range of the carriage, and when the wheel is exchanged, the carriage is moved to the position where the rotary box is arranged, thereby exchanging the wheel at that position.

Further, according to U.S. Pat. No. 4,357,115 (Background art 3), a plurality of semi-circular type plates are coaxially arranged, and only the necessary type plate is rotated so as to face the print hammer, thereby performing the printing operation by striking the type with the hammer.

In addition, according to the Official Gazette of Japanese Patent Application Laid-open No. 39464/1983 (Background art 4), a plurality of comb-tooth-like type plates in which respective free ends are interconnected and each comb tooth has a type are enclosed in the magazine, and this magazine is mounted in the carriage. The magazine is moved back and forth in the carriage, a desired type plate is picked up and at the same time, the carriage is laterally moved. Further, a desired type is shifted so as to face the print hammer by adjusting a pick-up amount (lift-up amount) of the type plate, thereby performing the printing operation by striking the type with the hammer.

The foregoing background arts were improvements in the art in that various kinds of characters can be printed; however, they have many inconveniences. For example, the total printing speed in the case of printing characters of one line is still slow.

Namely, in the background arts 1 and 2, the carriage must be moved to the position of the edge portion each time the type wheel is exchanged, so that many unproductive movements are performed and the total printing speed is slow.

In the background art 3, on the other hand, since the type plates are mounted on the carriage, the unproductive movement of the carriage is not performed when the type plate is exchanged; however, each type plate is semi-circular and the number of types which can be held by one type plate is remarkably reduced. Thus, the number of exchange times of the type plates increases and the total printing speed is slow.

On the other hand, in the background art 4, since the magazine in which a plurality of type plates are enclosed is mounted in the carriage, it is also possible to eliminate the unproductive movement of the carriage when the type plate is exchanged. However, since each type plate has a substantially comb-tooth shape, in order to shift a desired type to the printing position, the carriage must be moved not only in the feeding direction but also in the opposite direction. In the case where the carriage must be reciprocated to print characters of one line as mentioned above, this results in wasted motion of the carriage. In addition, the moving speed of the carriage itself cannot be increased, so that the printing speed becomes remarkably slow.

As described above, hitherto, the type wheel exchanging type printer having a high total printing speed doesn't exist.

On the other hand, hitherto, in the printer in which the carriage is equipped with the mechanism to exchange the type wheel, the weight of carriage is large, so that such a printer is unfitted for realization of the high-speed printing. Further, the carriage drive motor is also enlarged and not only the whole size of printer increases but also the electric power consumption also increases.

In the case where the magazine, in which a plurality of type plates, type wheels, or the like are enclosed is mounted in the carriage, wasted movement of the carriage when the type plate or type wheel is exchanged can be eliminated as mentioned above, so that this method is preferable. However, on the contrary, in this type of device there is also the problem that the whole carriage is enlarged in size. In addition the electric power consumption also increases.

If the enclosing space of the type plates or type wheels is near the attaching positions thereof, the exchanging speed is improved and the whole carriage can be also miniaturized, so that this constitution is desirable. With respect to this point, for example, the background art 4 is preferable since the magazine in which the type plates are enclosed is mounted in the carriage, and the type plate is lifted up to the striking position. In addition, a part of the type plate existing at the striking position is enclosed in the enclosing space in the magazine, thereby enabling the overall space to be further miniaturized. However, in this example, in order to allow the type to face the striking position of the hammer, it is necessary to secure the space commensurate with almost one type plate in each of the horizontal and vertical directions of the hammer respectively. Thus, the space of almost four type plates is needed as a whole. Consequently, a large space is necessary for the whole apparatus and it is difficult to miniaturize the printer.

SUMMARY OF THE INVENTION

It is an object of the present invention to provide a printer which can efficiently exchange the type wheel.

Another object of the invention is to improve the total printing speed in the case of printing a variety of characters.

Still another object of the invention is to lighten and simplify the means for exchanging the type wheel.

Still another object of the invention is to improve the exchanging speed of the type wheel.

Still another object of the invention is to enable a variety of characters to be selected and printed in the minimum limited space and thereby to miniaturize the whole apparatus.

The above and other objects and features of the present invention will become apparent from the following detailed description and the appended claims with reference to the accompanying drawings.

BRIEF DESCRIPTION OF THE DRAWINGS

FIGS. 1–28 illustrate a first embodiment of the present invention, in which:

FIG. 1 is a partially cut away plan view of the printer chassis of the present invention;

FIG. 2 is a partial rear elevational view of type wheels and their supporting structure;

FIG. 3 is a partial side elevational view with a part shown as a cross sectional view of type wheels and their supporting structure;

FIG. 4 is a partial side elevational view having a part shown in cross sectional view of a portion of the printer chassis;

FIG. 5 is a partial plan view, partially cut away, of the printer chassis and the carriage;

FIG. 6 is a partial side elevational view with a part cut away of the box enclosing the print wheels;

FIG. 7 is a partial perspective view partially cut away of a cradle of the enclosing box of the present invention;

FIGS. 8 to 10 are partial side elevational views showing different operating states, respectively, of bodies which engage the box enclosing the type wheels;

FIG. 11 is a partial side elevational view, partially cut away, of a portion of the printer of the present invention including the cover of the enclosing box, and the pulse motor for moving the cradle;

FIG. 12 is a partial front cross sectional view of the mechanism for supporting the type wheel at its pick up position;

FIG. 13 is a partial front view showing an operating state of the invention different from FIG. 12;

FIG. 14 is a partial enlarged plan view of a body engaging a portion of the type wheels;

FIG. 15 is a partial enlarged side elevational view showing an operating state of the invention different from FIG. 4;

FIG. 16 is a partial enlarged side cross sectional view of a rotary body of the present invention;

FIGS. 17 and 18 are partial enlarge side cross sectional views showing different operating states of the rotary body, respectively;

FIG. 19 is a partial enlarged plan view, partially in cross section of a pulse motor and the type wheels;

FIG. 20 is a partial enlarged side elevational view showing an operating state of the invention different from FIG. 15;

FIG. 21 is a partial enlarged front view showing an operating state of the type wheel different from FIG. 13 in which the type wheel is attached to a rotary shaft;

FIG. 22 is a partial enlarged perspective view of a crank, a cam, and a supporting plate of the present invention;

FIG. 23 is a partial enlarged perspective view of the pulse motor and gears for driving the type wheels;

FIG. 24 is a partial enlarged perspective view of the cradle and carriage of the present invention; and FIG. 25 is a partial enlarged perspective view of the box for enclosing the type wheels;

FIG. 26 is a timing chart showing the operation timing of a rotary body and of each section of the present invention;

FIG. 27 is a block circuit diagram of the first embodiment; and

FIG. 28 is a flowchart illustrating the operation of the first embodiment.

Figure 29:
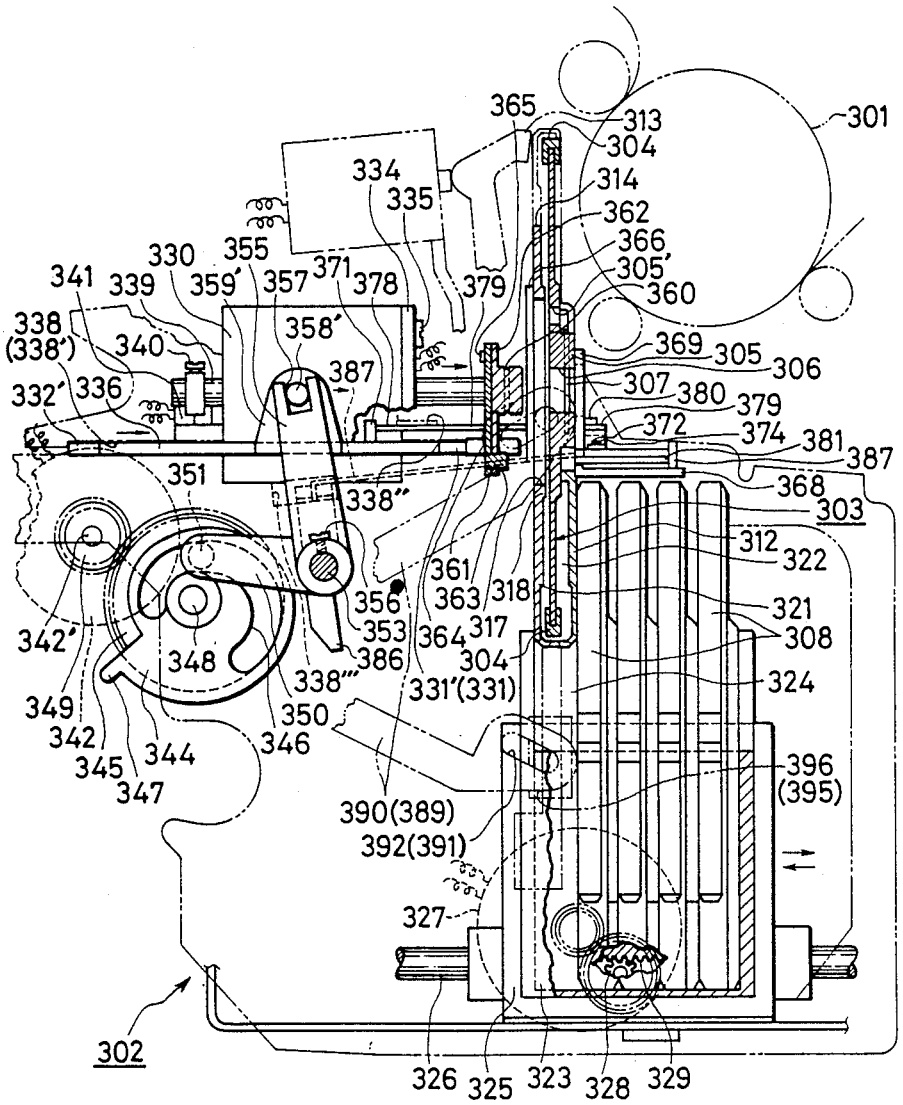
Figure 30:
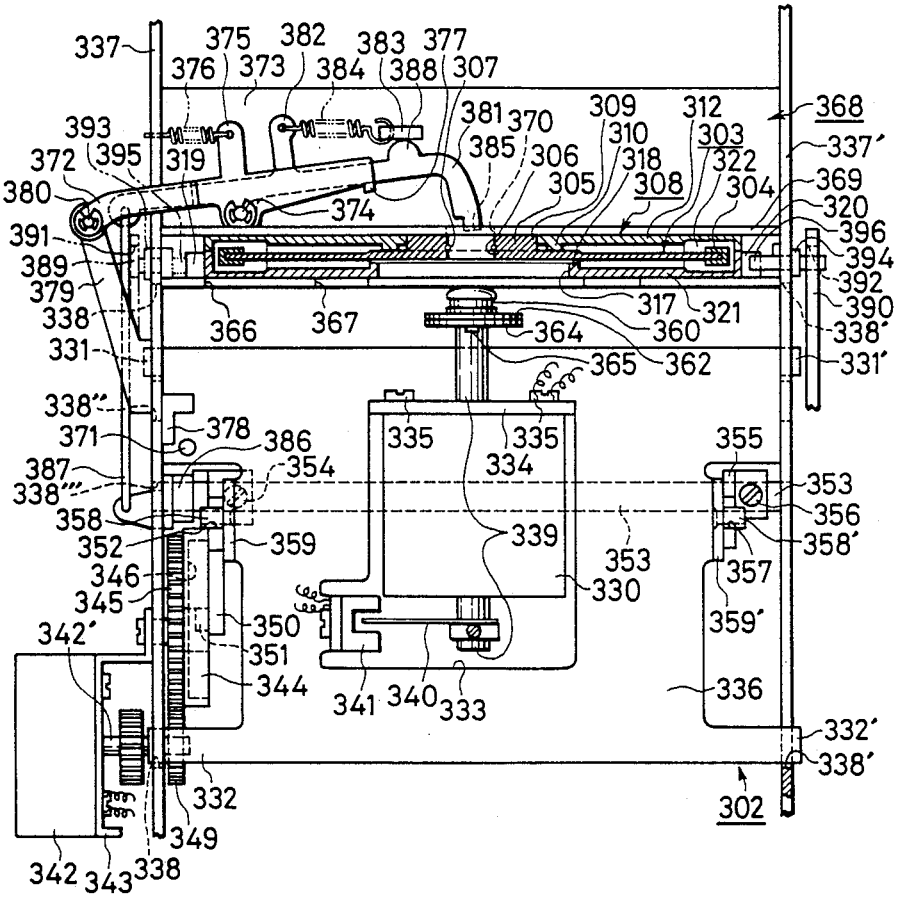
Figure 31:
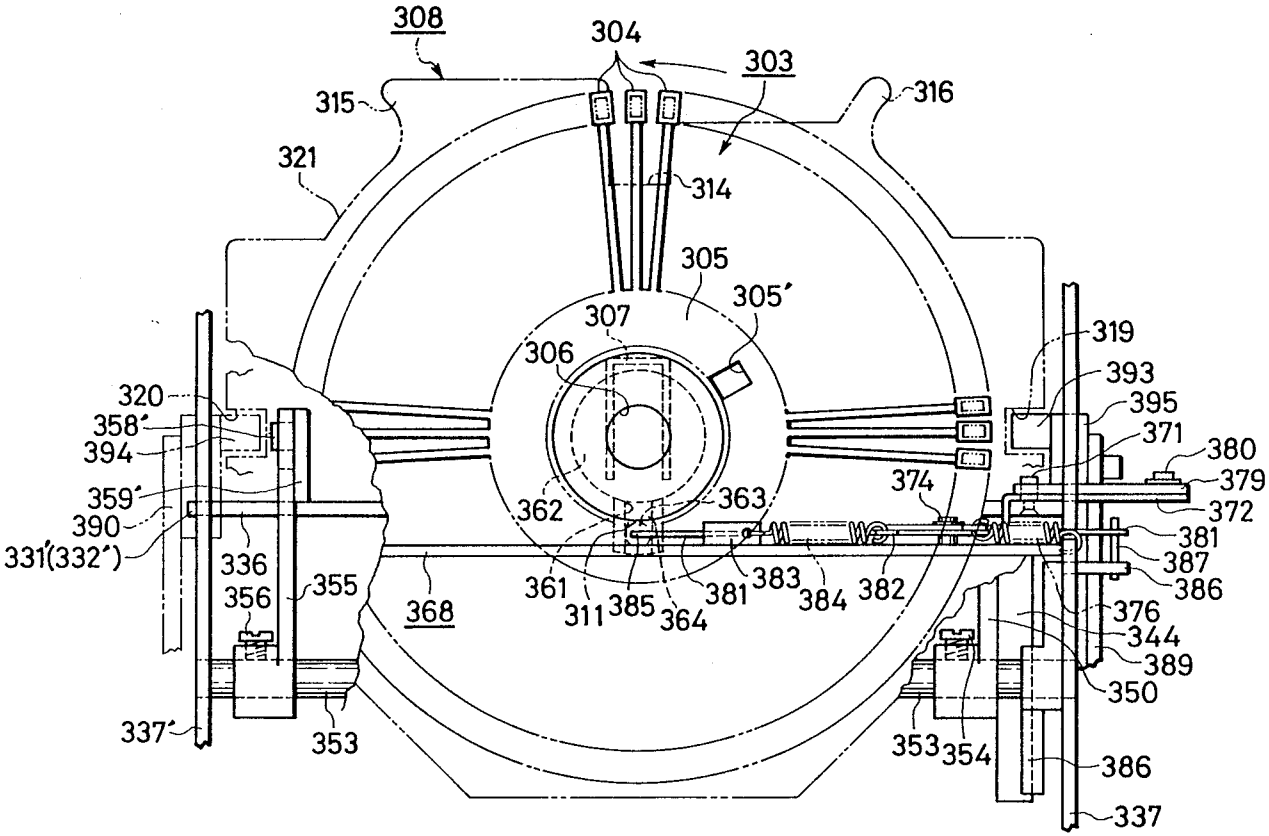
Figure 32:
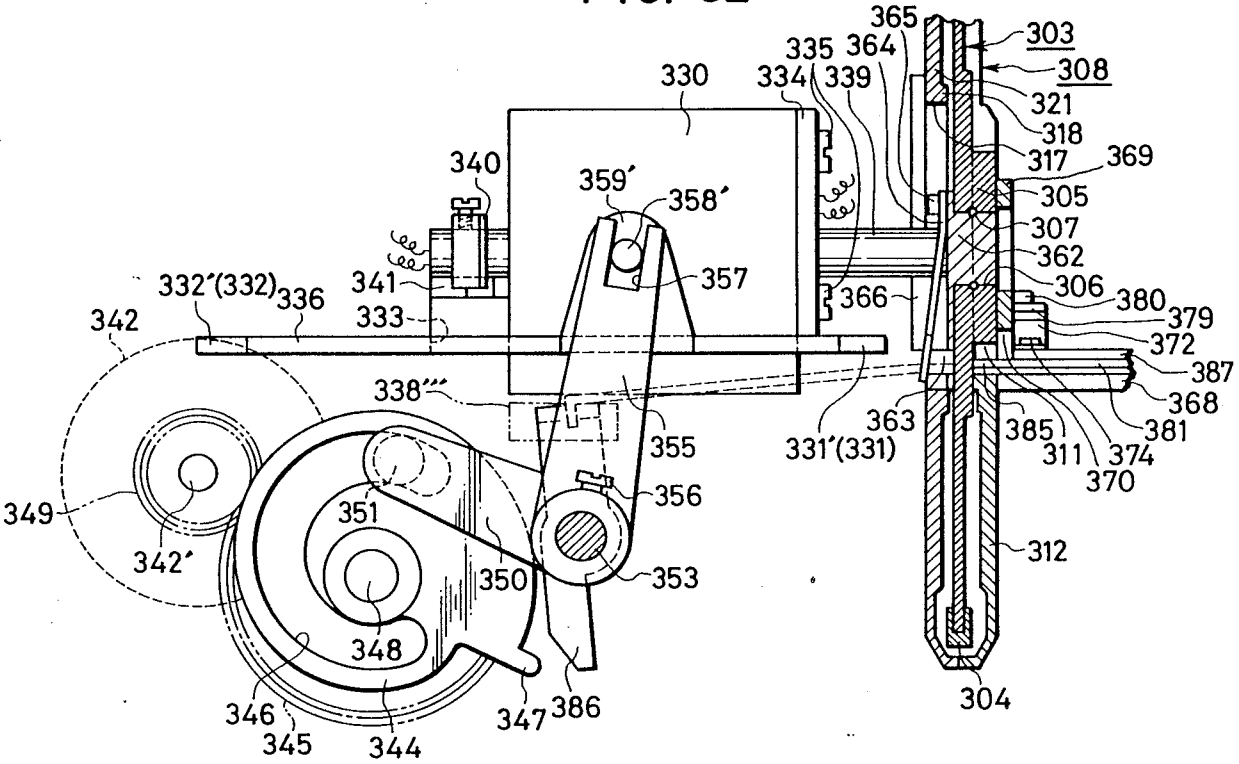
Figure 33:
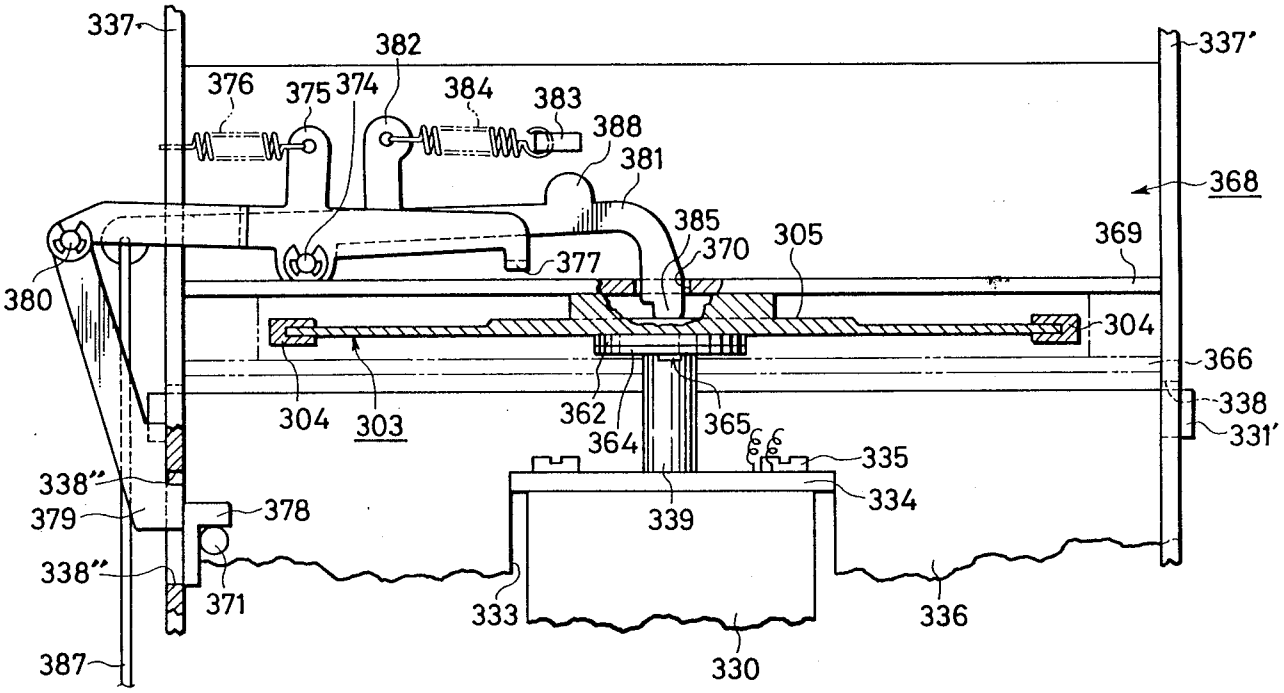
Figure 35:
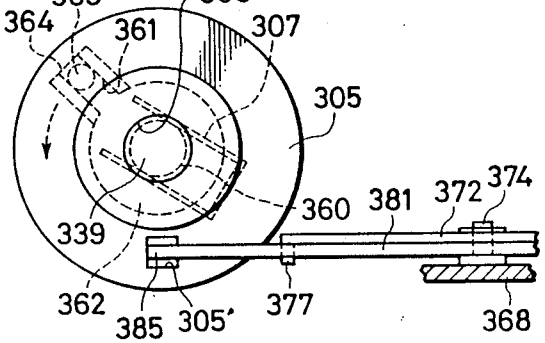
Figure 37:
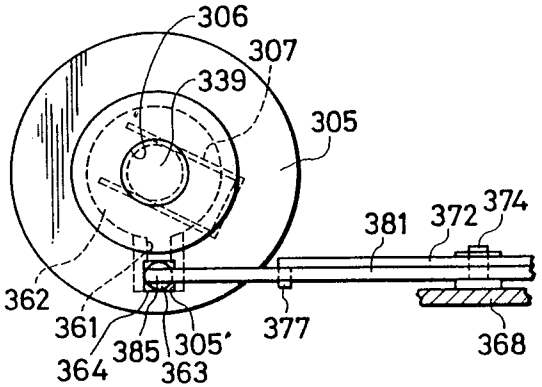
Figure 34:
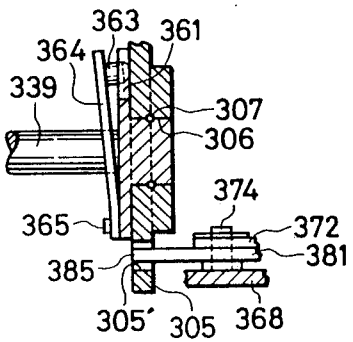
Figure 36:
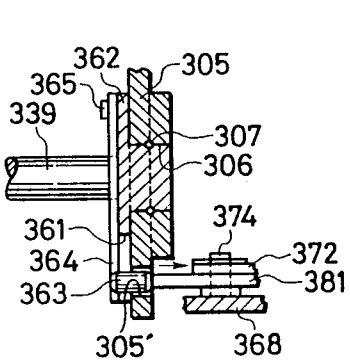
Figure 38:
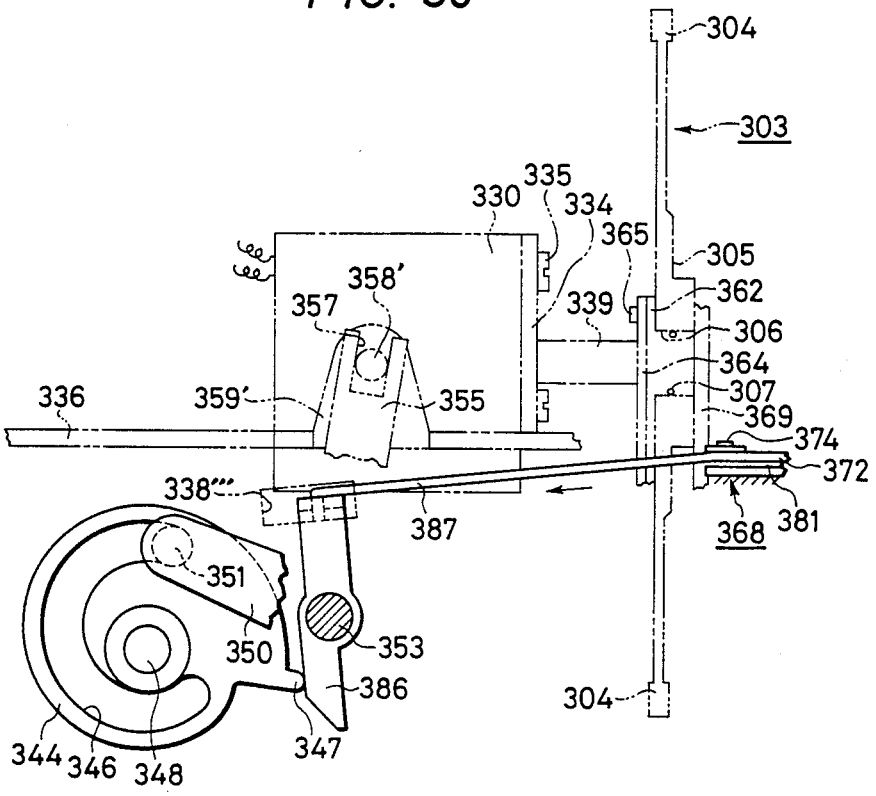
Figure 39:
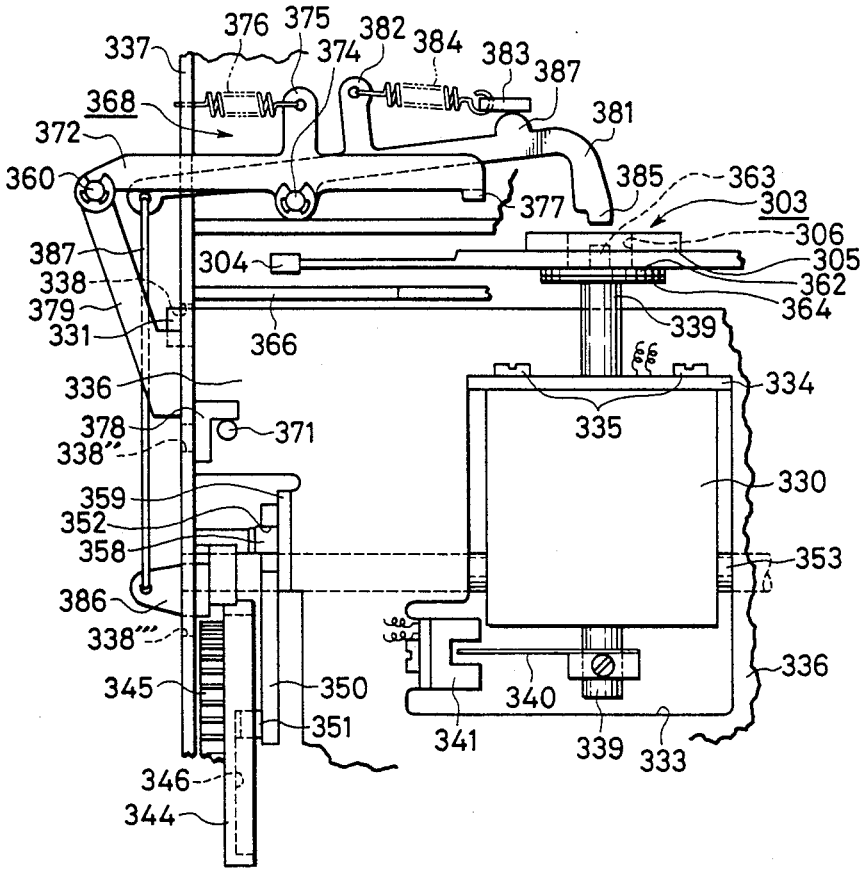

The following drawings show another embodiment of the present invention, in which:

FIG. 29 is a partial side elevational view with a part cut away, of the carriage and platen of the present invention;

FIG. 30 is a partial plan view with a part cut away of the carriage of the present invention;

FIG. 31 is a partial rear view with a part cut away of the carriage and the daisy wheel of the present invention;

FIG. 32 is a partial side elevational view with a part cut away of the drive motor and the daisy wheel of the present invention;

FIG. 33 is a partial plan view showing an operating state of the carriage different from FIG. 30;

FIG. 34 is a partial side cross sectional view of the daisy wheel of the present invention;

FIG. 35 is a partial rear elevational view of the daisy wheel of the present invention;

FIG. 36 is a partial side cross sectional view showing an operating state of the daisy wheel different from FIG. 34;

FIG. 37 is a partial rear elevational view showing an operating state of the daisy wheel different from FIG. 35;

FIG. 38 is a partial side elevational view showing an operating state of the carriage different from FIG. 32; and FIG. 39 is a partial plan view showing an operating state of the carriage different from FIG. 33.

DESCRIPTION OF THE PREFERRED EMBODIMENTS

Figure 1:
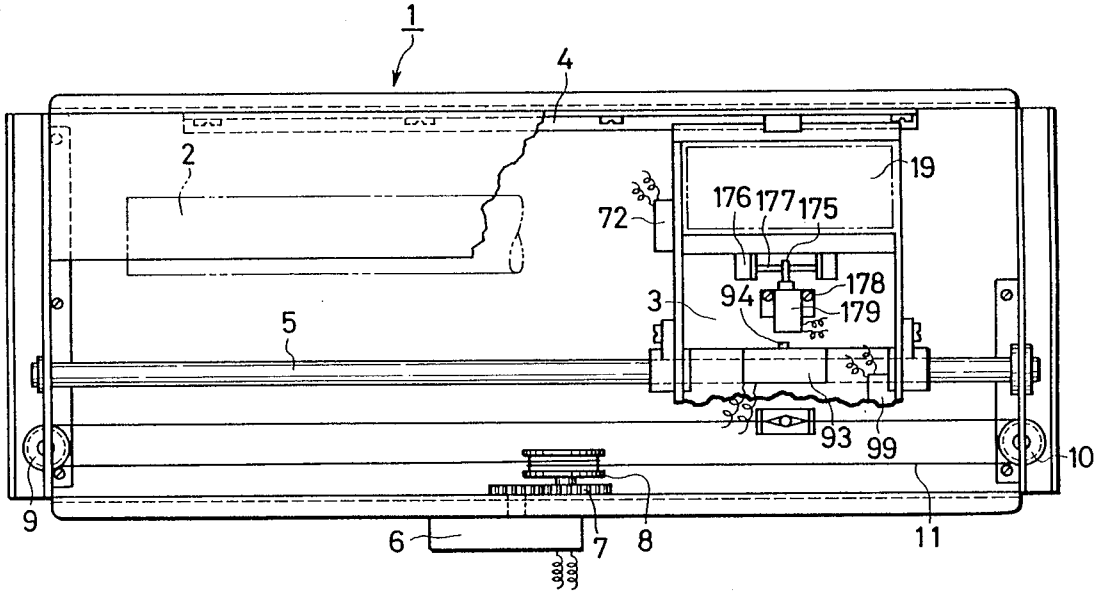
Figure 3:
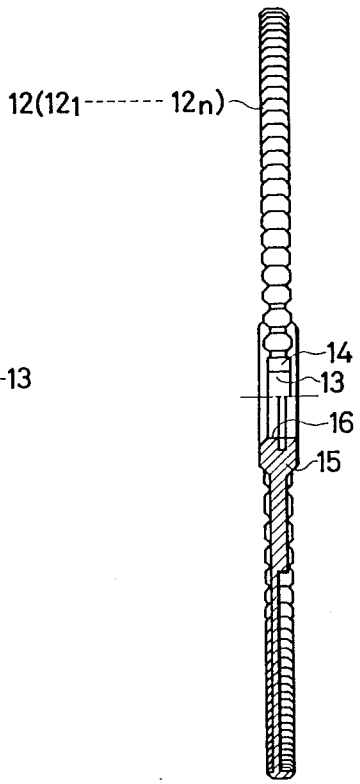
Figure 2:
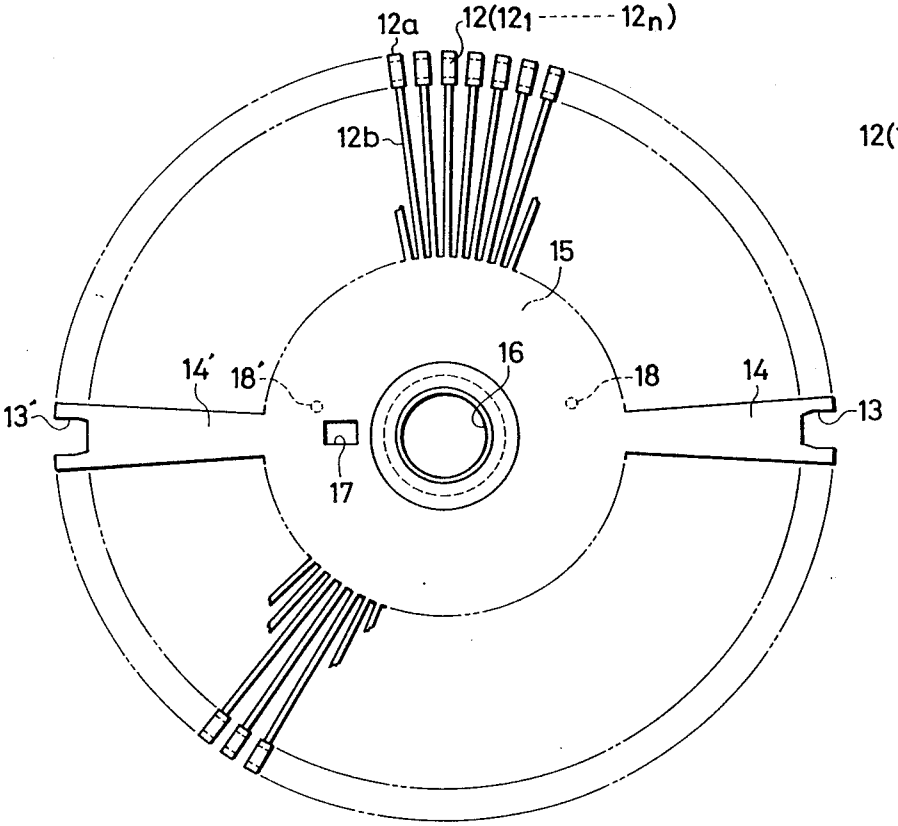

FIGS. 1 to 28 show a printer of the automatic type wheel exchanging type as the first embodiment of the present invention. In FIG. 1, reference numeral 1 denotes a printer chassis. A well-known platen 2 is rotatably attached to the chassis and formed to have a long shape so as to support the back surface of a print paper. A carriage 3 is mounted in the chassis 1 through a rail 4 and a supporting shaft 5 and the like so as to be laterally slidable in FIG. 1. A pulse motor 6 to drive the carriage is arranged at a proper position (almost at the central position on this side in FIG. 1) of the chassis 1. The rotation of the pulse motor is transferred to the carriage 3 through conductive gears 7 and pulleys 8, 9, and 10 attached to the chassis and further through a wire 11 or the like. The carriage 3 is movable in the longitudinal direction of the platen, namely, in the lateral direction in FIG. 1 with respect to the chassis 1 by the rotation of the pulse motor 6. In FIGS. 2 and 3, numeral 12 ($12_1$, . . . , $12_n$) denotes type wheels in each of which type portions **12*a* are annularly arranged on one side of each of the edge portions of spokes 12*b* radially formed. A pair of arm portions 14 and 14' having notches 13 and 13' at respective end portions are formed at the positions away from each other by an angle of about 180° so as to be projected from a central boss portion 15. An attaching hole 16 is formed in the boss portion 15 at the center. A retaining hole 17 is also formed in the boss portion 15 at the position offset beside the attaching hole 16 (namely, on the left in FIG. 2**).

Further, a pair of retaining pins 18 and 18' are formed in the boss portion 15 at the positions in parallel with the arm portions 14 and 14' on one side of the boss portion 15, respectively. The type portions in which the character styles, sizes, kinds of characters, and the like differ for every type wheel 12 ($12_1, \ldots, 12_n$) are provided.

Figure 12:
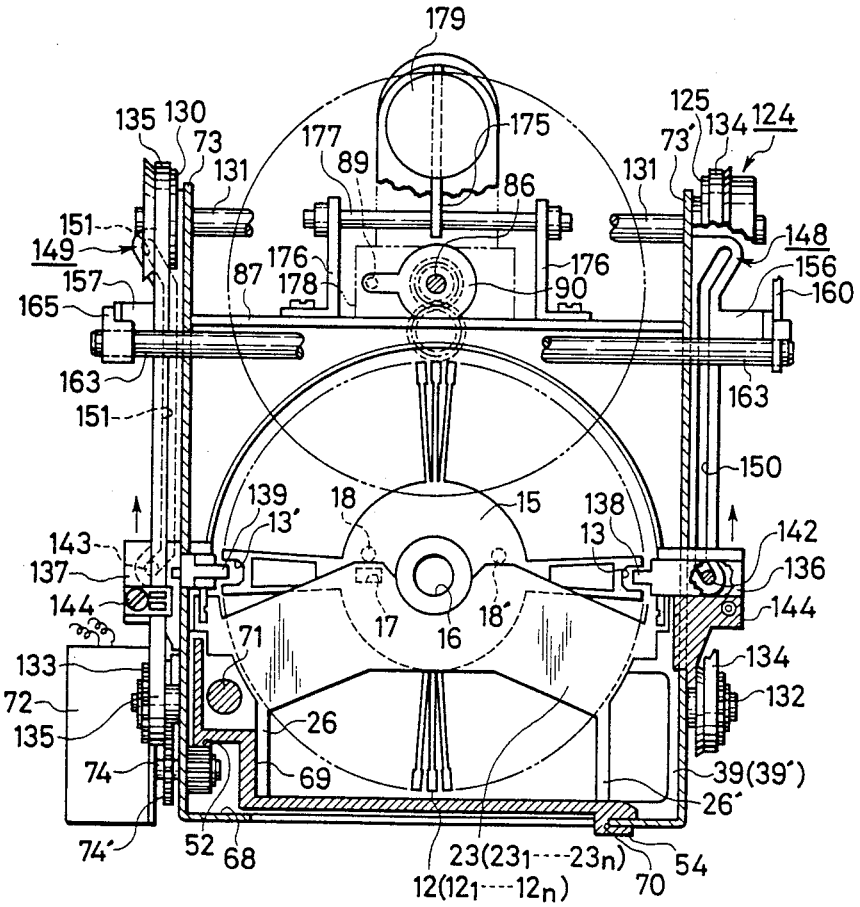
Figure 13:
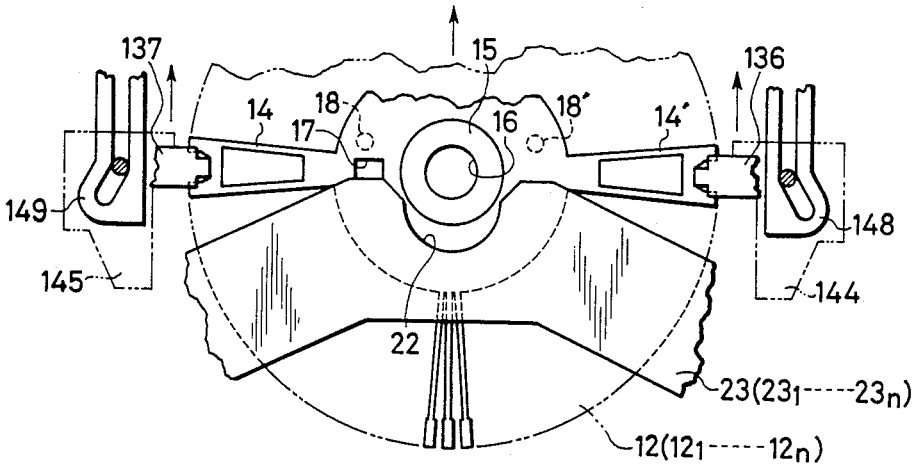
Figure 14:
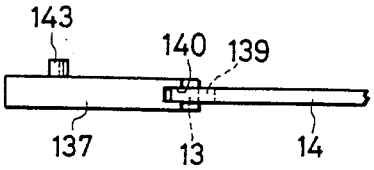
Figure 25:
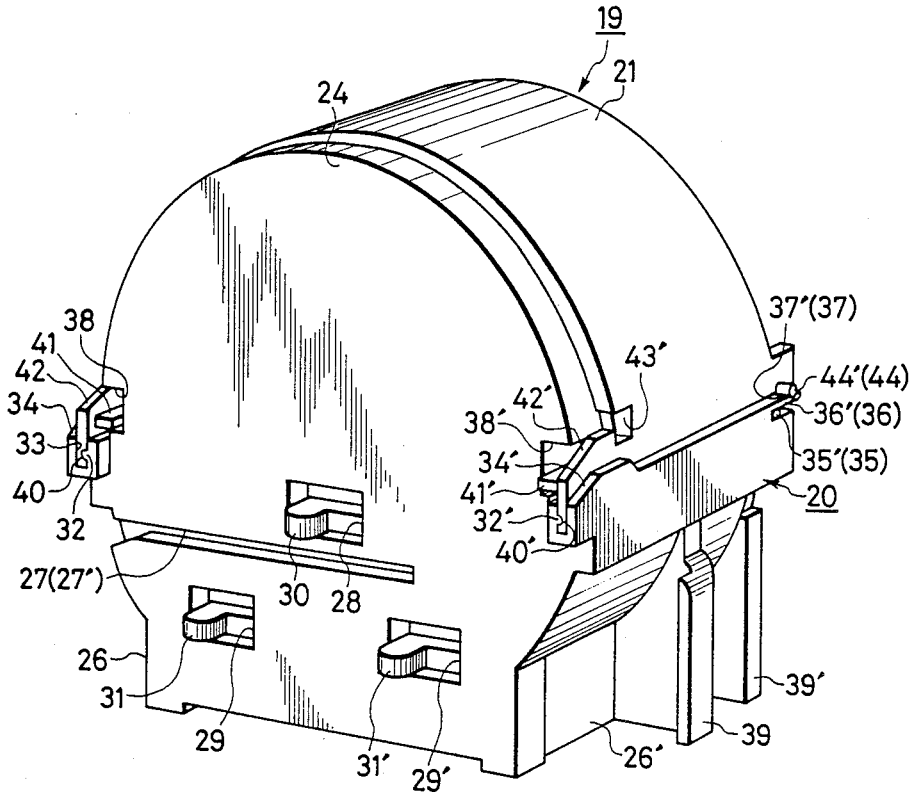
Figure 25:
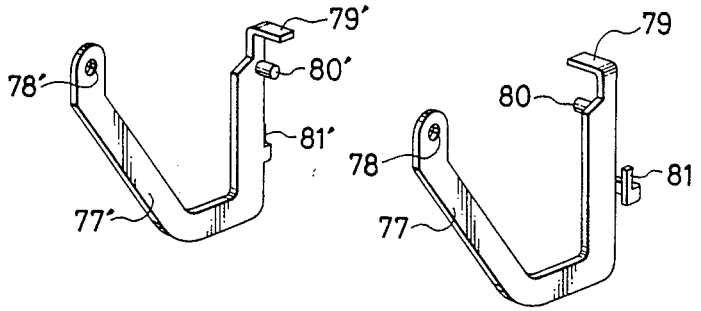

In FIG. 1, numeral 19 denotes an enclosing box (wheel magazine) for enclosing the type wheels, made of a high molecular compound material. As shown in FIGS. 12 and 25, the enclosing box 19 is mainly constituted by a box 20 whose upper and lower portions are respectively open and a cover 21 to cover the upper portion of the box 20. A number of supporting plates 23 ($23_1, \ldots, 23_n$) are integrally provided in the box 20 at regular intervals between left and right side plates 26 and 26' from a side plate 24 on one side to a side plate 25 on the other side whose upper portions are respectively formed like almost a semi-arc. Each of the supporting plates 23 serves as a partition and is formed substantially like an inverted "V" shape and a notch 22 for supporting the boss portion 15 of the type wheel is formed substantially in the central portion of each of the supporting plates 23. The boss portions 15 of the type wheels 12 ($12_1, \ldots, 12_n$) are supported in the notches 22 of the supporting plates 23 ($23_1, \ldots 23_n$), respectively. The respective pins 18 and 18' are retained into the supporting plates 23 ($23_1 \ldots, 23_n$) from the upper portions thereof, respectively. Thus, the type wheels 12 ($12_1, \ldots, 12_n$) can be upwardly moved at regular intervals away from one another at the position of the box 20. The arm portions 14 and 14' of each of the type wheels 12 ($12_1, \ldots, 12_n$) are located substantially horizontally, thereby enabling these type wheels to be enclosed into the box 20, respectively. On the other hand, a pair of long grooves 27 and 27' for engagement in each of which one end (on the left side in FIG. 25) is open are formed in the side plates 24 and 25 at the positions which are slightly lower (on this side in FIG. 25) than almost the central portions of these side plates, respectively. A through hole 28 is formed in the side plate 24 on this side at the upper position and a pair of through holes 29 and 29' are also formed in the side plate 24 at the lower positions in a manner so as to sandwich the long groove 27. Each of free members 30, 31, and 31' has almost an inverted "L" shape. One end of each of these free members is so arranged as to face this side from the side plate 24 (namely, on this side in FIG. 25) in a manner such as to be slightly projected from the through holes 28, 29, and 29', respectively. An engaging groove 33 and another engaging groove are formed in the upper edge portions of the left and right side plates 26 and 26' of the box 20, respectively. The grooves 33 and 33' have almost U-shaped cross sections and engaging projections 32 and 32' are formed in these grooves, respectively. Further, a pair of cam surfaces 34 and 34' are formed on each end (on the ends on this side in FIG. 25) of the outer side portions forming the engaging grooves 33 and 33'. A pair of free end portions 36 and 36' are formed by notches 35 and 35' formed in the other edge portions of those outer side portions, respectively. Retaining recesses 37 and 37' are formed in the upper side edges of the free end portions 36 and 36', respectively. A pair of guide notches 38 and 38' are formed in the side plates 24 and 25 at the positions which are slightly higher than the positions which face the pair of engaging grooves 33 and 33', respectively. A pair of operating members 39 and 39' are formed outwardly (rightwardly in FIG. 25) in the lower portion of the right side plate 26', respectively. As shown in FIG. 25, the cover 21 is formed like an almost semi-arc so as to sufficiently cover the upper region between the side plates 24 and 25 of the box 20 in a manner such that the portions on the two sides of the left and right lower base portions are slightly projected to these two sides respectively. A pair of grooves 40 and 40' adapted to come into engagement with the projections 32 and 32' of the engaging grooves 33 and 33' of the box 20 are formed in those base portions, respectively. A pair of stop members 41, 41' to obstruct the free oscillation of the type wheels 12 ($12_1, \ldots 12_n$), which will be explained in detail hereinafter, are formed at slightly higher positions of the grooves 40 and 40' so as to pass through the notches 38 and 38' of the box 20 toward the inside, respectively. A pair of engaging notches 43 and 43' communicated with a pair of inclined portions 42 and 42' formed forwardly from this side of the base portions are formed in the slightly upper side edges on this side of the base portions, respectively. In addition, a pair of pins 44 and 44' to retain the cover 21 and adapted to come into engagement with the recesses 37 and 37' of the box 20 are projectingly and outwardly formed from the front portions of the base portions, respectively. As mentioned above, after the type wheels 12 ($12_1, \ldots, 12_n$) are respectively inserted into the box 20, the grooves 40 and 40' of the cover 21 are inserted to the projections 32 and 32' of the engaging grooves 33 and 33' of the box 20 from the forward position to this side in FIG. 25. Further, the stop members 41 and 41' of the cover 21 come into engagement with the notches 13 and 13' of the arm portions 14 and 14' of the type wheels through the notches 38 and 38' of the box 20 and are moved, respectively. The pins 44 and 44' respectively come into engagement with the recesses 37 and 37' of the box 20, and then the box 20 is covered by the cover 21 In this manner, the type wheels 12 ($12_1, \ldots, 12_n$) can be enclosed without oscillating in the enclosing box 19 of the type wheels.

Figure 7:
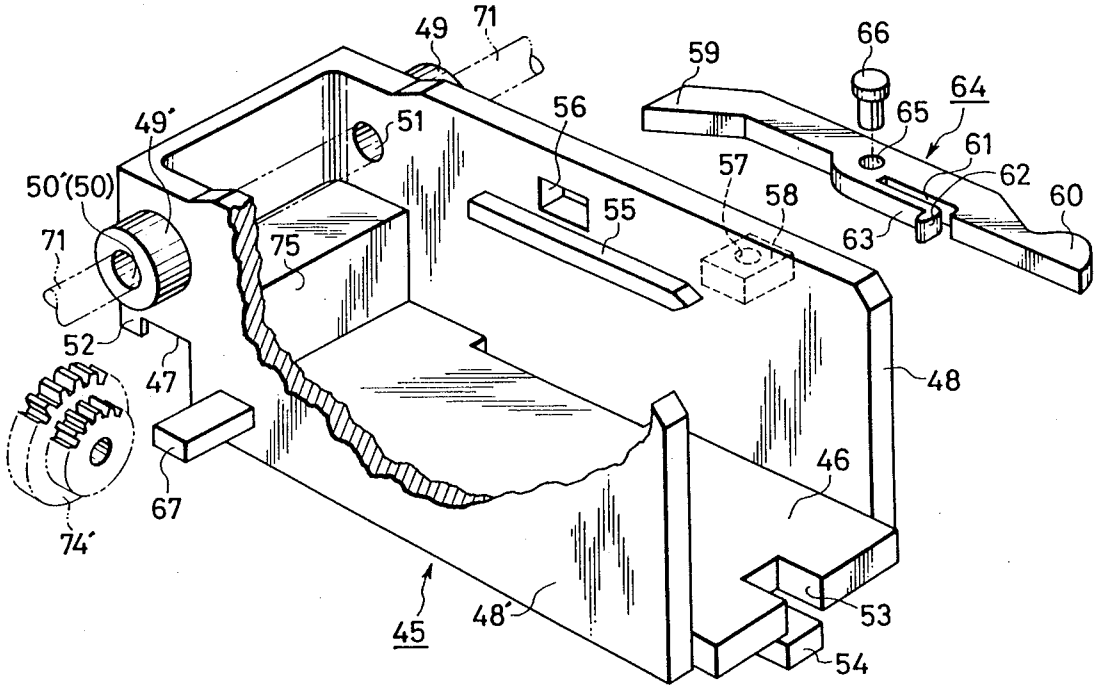
Figure 10:
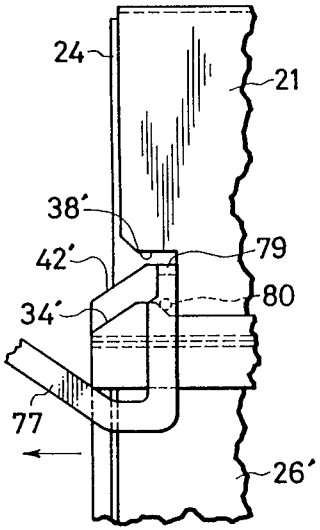
Figure 9:
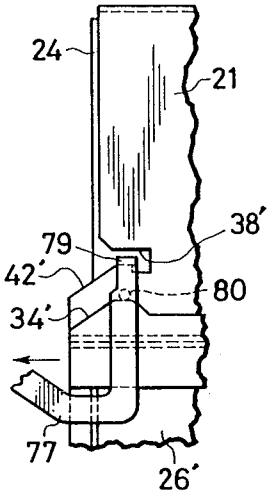
Figure 8:
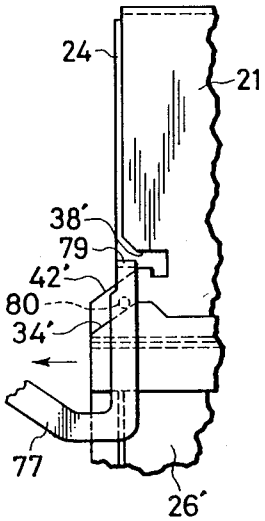
Figure 11:
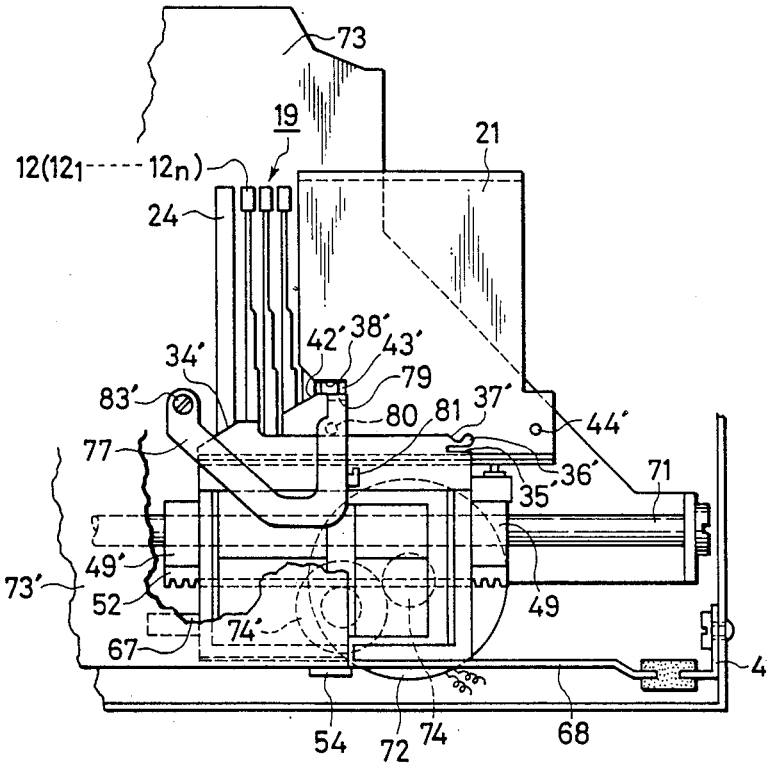

In FIG. 7, reference numeral 45 denotes a cradle of the enclosing box 19 of the type wheels. The cradle 45 is mainly formed like a box in which the upper portion and each end (on the right side in FIG. 7) are open and at the same time which has a recess portion 47 which is formed by upwardly bending a part (at the left upper portion in FIG. 7) of a bottom plate 46 of the cradle 45. Attaching hole 51 and another attaching hole communicating with boss holes 50 and 50' of a pair of bosses 49 and 49' formed on the outsides of both side plates 48 and 48' of the cradle 45 are formed in each end (at the left end portion in FIG. 7) of the side plates 48 and 48', respectively. A driving rack 52 is formed in the lower edge portion of each end of the side plates 48 and 48' (lower edge portion of the left end portion in FIG. 7). A notch 53 and an engaging tongue portion 54 are respectively formed in the other end portion (right end portion in FIG. 7) of the bottom plate 46. A pair of engaging projections one of which is denoted as reference number 55, are adapted to come into engagement with the long grooves 27 and 27' of the box 20 are projectingly formed in the side plates 48 and 48', respectively.

An engaging hole 56 is formed at the position of the side plate 48 which is slightly higher than the projection 55. On the other hand, a projecting member 58 having an attaching hole 57 is outwardly (forwardly in FIG. 7) and projectingly formed to the outside (front side near the right end portion in FIG. 7) near one end portion of the side plate 48. A retaining pawl lever 64 made of a material such as high molecular compound or the like is mounted over the projecting member 58. The lever 64 comprises: at one end, a pawl portion 59 adapted to be come into engagement with the hole 56 in the side plate 48, at the other end, an operating member 60; and a free engaging portion 63 which is formed on one side by a notch 61 and which has a projecting portion 62 for engagement in one side edge portion. In this case, the lever 64 is mounted by inserting a pin 66 into the attaching hole 57 of the projecting member 58 through a hole 65 formed in the lever 64 and by allowing the projecting portion 62 to come into engagement with the side plate 48. Therefore, the pawl portion 59 is always projected from the inside of the side plate 48 through the hole 56 and positioned due to the elastic force by such an engagement. Numeral 67 denotes an operating member formed so as to project to the outside near one end portion of the side plate 48' on the other side. The operating member 67 is provided to make a sensor A operative, which will be explained in detail hereinafter.

Figure 24:
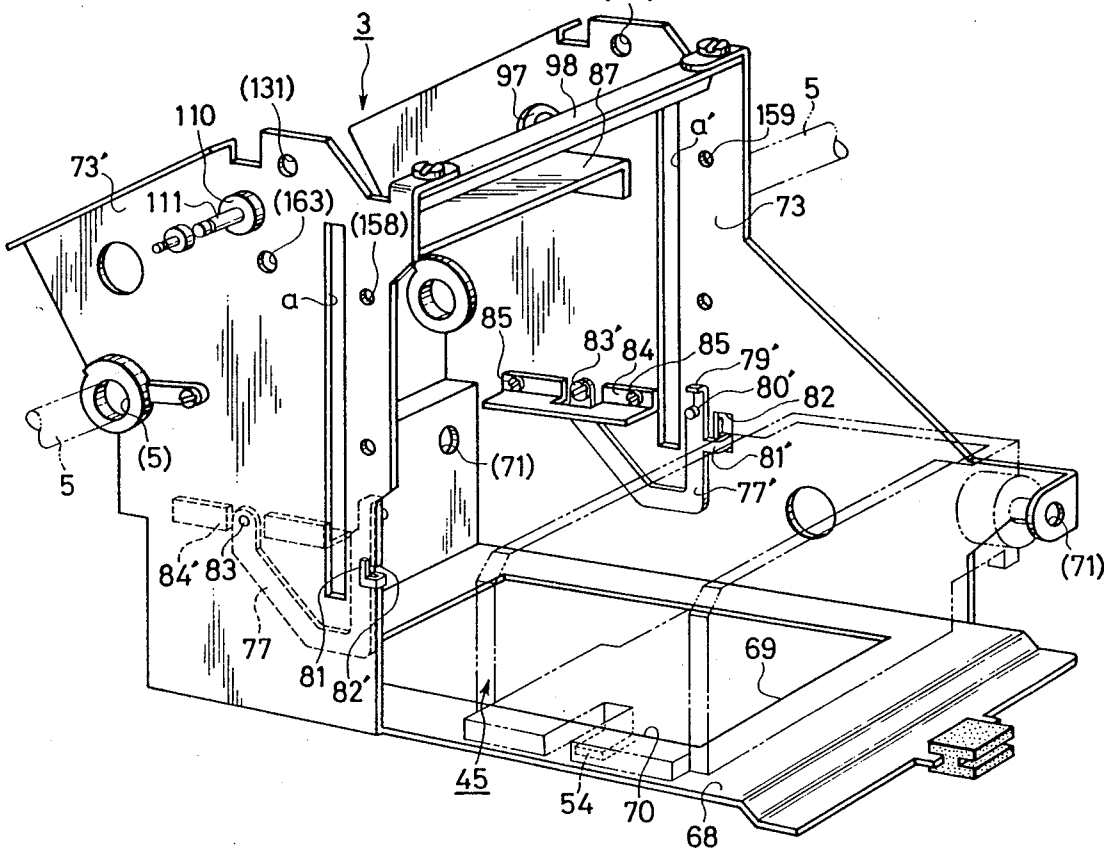

As shown in FIG. 24, the cradle 45 constituted as described above is mounted on a bottom plate 68 of the carriage 3 so as to be slidable in the longitudinal direction of a guide shaft 71 in the following manner. Namely, the tongue portion 54 comes into engagement from the lower side of the bottom plate 68 with one side edge portion 70 of a through hole 69 formed in the bottom plate 68 from one side (mainly, this side in FIG. 24) of the opening portion of the carriage 3. The boss holes 50 and 50' of the cradle 45 and the holes 51 and 51' of the side plates 48 and 48' respectively come into engagement with the guide shaft 71 fixed to the carriage 3. The cradle 45 is guided by such engagement, so that it can slide in the longitudinal direction of the guide shaft 71 on the bottom plate 68 of the carriage 3. The shaft 71 crosses perpendicular to the guide shaft 5 of the carriage 3, so that the cradle 45 and type wheel enclosing box 19 can move in the direction perpendicular to the moving direction of the carriage. A desired type wheel can be selected due to this movement.

The enclosing box 19 is detachable in the direction perpendicular to the shaft 71 with respect to the cradle 45, so that the box 19 is attached and detached in the direction which is parallel with the moving direction of the carriage 3. When the enclosing box 19 is attached and detached in the moving direction of the carriage 3 as mentioned above, the enclosing box 19 can be attached and detached with the hand by inserting the hand from the lateral direction of the carriage and therefore a special space for attachment and detachment is unnecessary.

Numeral 72 (FIG. 11) denotes a pulse motor to move the cradle 45. This pulse motor is attached to one side plate 73 of the carriage 3. As shown in FIG. 7, a rotary shaft 74 of the pulse motor 72 is coupled with the rack 52 of the cradle 45 through a gear 74', thereby enabling the cradle 45 to be slid over the carriage 3 as mentioned above by the rotation of the rotary shaft 74. Therefore, the long grooves 27 and 27' of the box 20 of the enclosing box 19 in which the type wheels 12 ($12_1, \ldots, 12_n$) were enclosed as shown in FIG. 25 come into engagement with the pair of engaging projections one of which is denoted as reference numeral 55 of the cradle 45 from one opening of the cradle 45 mounted on the carriage 3. The free members 30, 31, and 31' of the box 20 elastically come into engagement with the inside of the side plate 48' of the cradle 45 and are inserted therein until the left side plate 26 fully engages a stairlike inner surface 75 of the bottom plate 46. The pawl portion 59 piercing through the hole 56 of the retaining pawl lever 64 elastically comes into engagement with a retaining hole 76 formed in the box 20, thereby attaching the enclosing box 19 onto the cradle 45. Thus, the type wheels 12 ($12_1, \ldots, 12_n$) can be moved together with the enclosing box 19 and cradle 45 with respect to the carriage 3 by the rotation of the pulse motor 72 due to the moving mechanism consisting of the foregoing constitutions including the pulse motor.

In FIG. 25, numerals 77 and 77' denote a pair of engaging bodies each of which is formed in an almost V-character shape. Attaching holes 78 and 78' are respectively formed in each end of the engaging bodies 77 and 77'. The other ends of these bodies are inwardly bent by an angle of about 90° to form engaging projections 79 and 79', respectively. Pins 80 and 80', adapted to come into engagement with the cam surfaces 34' and 34 of the box 20, are inwardly formed slightly below (on this side in FIG. 25) the projections 79 and 79', respectively. Further, projections 81 and 81' to restrict the oscillating positions are formed below the pins 80 and 80' by bending the projections in the directions opposite to the bending directions of the pins 80 and 80' and further by bending these bent projections by an angle of 90° (to this side in FIG. 25), respectively. As shown in FIG. 24, the projections 81 and 81' are arranged at the positions such that they can swing in long holes 82' and 82 formed in the side plates 73' and 73 of the carriage 3. In this state, the engaging bodies 77 and 77' are attached so as to swing in the side plates 73 and 73' by the holes 78' and 78 and axes 83 and 83', respectively. Numerals 84 and 84' denote stop members each of which is formed substantially like a ⊥-shape. The stop members 84 and 84' are respectively formed at the positions so as to face the stop members 41 and 41' of the cover 21 inside of the side plates 73 and 73' of the carriage 3 and fixed by screws 85 and 85', respectively.

Figure 5:
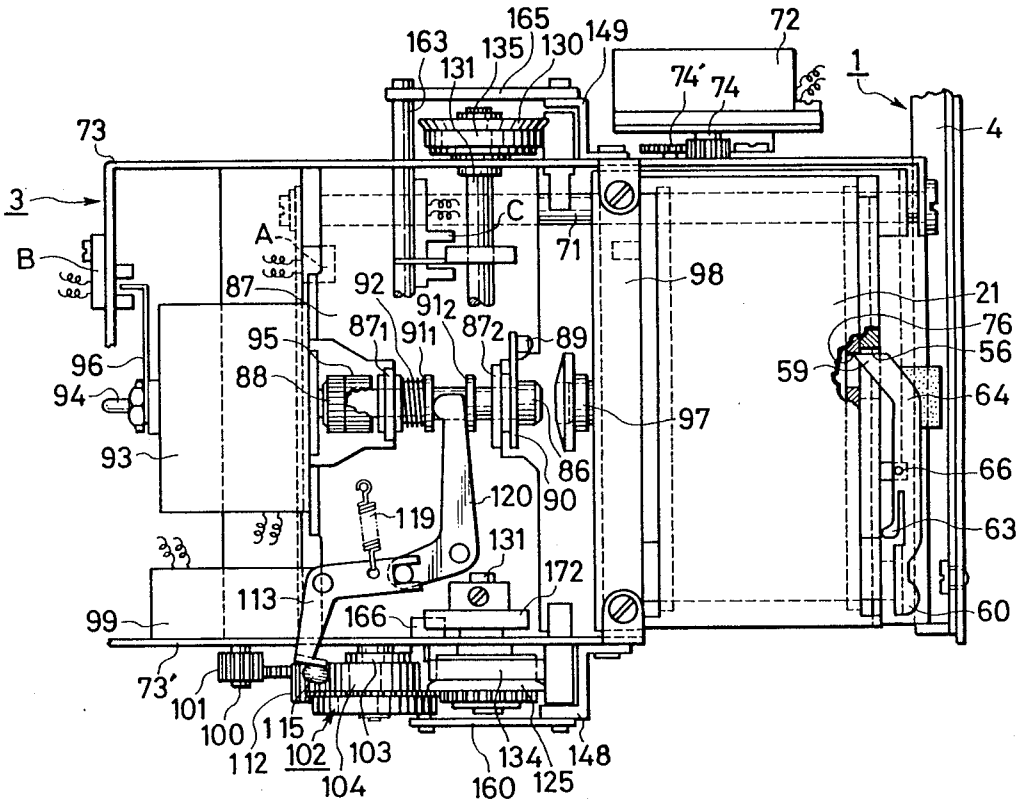
Figure 6:
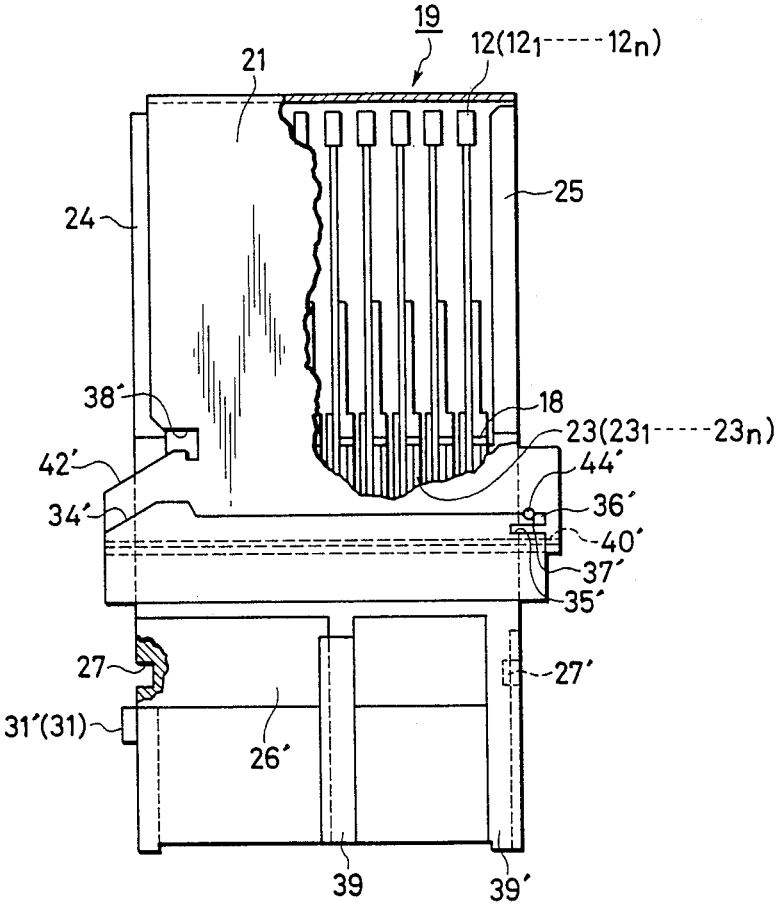

In FIG. 5, numeral 86 denotes a rotary shaft to rotate the type wheels 12 ($12_1, \ldots, 12_n$). The rotary shaft 86 is attached to the carriage 3 so as to be slidable through ear portions $87_1$ and $87_2$ of an attaching metal fitting 87 in the axial direction (lateral direction in FIG. 5) thereof. Namely, the rotary shaft 86 is attached at the upper side position of substantially the central portion between side plates 73 and 73' of the carriage 3 (i.e., in front of the center in the lateral direction in FIG. 12) and at the position which is forwardly deviated from the center in the forward/backward direction of the carriage 3 (i.e., at the position which is deviated to the left from the center in the lateral direction in FIG. 5). A conductive gear 88 is integrally fixed to one end portion of the rotary shaft 86 and a retaining member 90 is integrally fixed to the other end portion at the position which is slightly deviated toward one end portion of the rotary shaft 86. The retaining member 90 has at one side (on the right side in FIG. 5) a projection 89 adapted to be inserted into the retaining hole 17 of the type wheels 12 ($12_1, \ldots, 12_n$) A pair of flanges $91_1$ and $91_2$ for engagement are formed with a slight distance S at substantially the central portion of the rotary shaft 86, respectively. A compression spring 92 is arranged between the flange $91_1$ and the ear portion $87_1$ of the attaching metal fitting 87. The rotary shaft 86 is always urged by the force of the compression spring 92 so as to slide in one direction (to the right in FIG. 5). The slide motion of the rotary shaft 86 by the urging force of the spring 92 is obstructed due to the collision of the other flange $91_2$ with the other ear portion $87_2$. A pulse motor 93 to drive the rotary shaft 86 functions as drive means for rotating the attached type wheel. The pulse motor 93 is attached to the carriage 3 through the metal fitting 87 so as to be located at the leftward position of the rotary shaft 86 in FIG. 5. The conductive gear 88 of the rotary shaft 86 always engages a gear 95 attached to one end portion (right end portion in FIG. 5) of a rotary shaft 94 of the pulse motor 93. Thus, the rotary shaft 86 is rotated by the rotation of the pulse motor 93 through the gear 95 and conductive gear 88. An operating member 96 to make a sensor B operative, which will be explained in detail hereinafter, is integrally attached to the other end portion (left end portion in FIG. 5) of the rotary shaft 94 of the pulse motor 93. A bearing 97 of the rotary shaft 86 is attached to an attaching plate 98 arranged between the side plates 73 and 73' of the carriage 3 so that one end portion (right end portion in FIG. 5) of the rotary shaft 86 can be rotatably supported when the rotary shaft 86 is slided to the right in FIG. 5. A pulse motor 99 is provided both for sliding the rotary shaft 86 and for vertically moving the type wheels 12 ($12_1, \ldots, 12_n$). The pulse motor 99 is arranged in front of the left end portion (in FIG. 5) of the side plate 73' of the carriage 3. A gear 101 is fixed to a rotary shaft 100 into which the side plate 73' is inserted to this side in FIG. 5.

Figure 15:
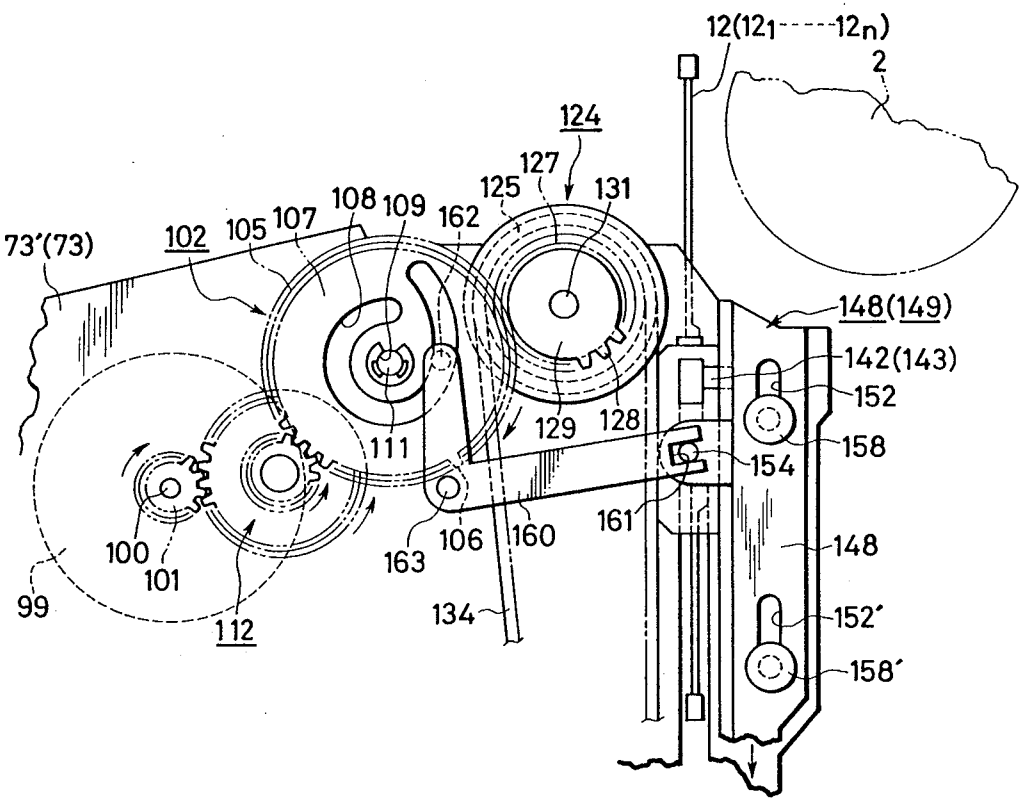
Figure 16:
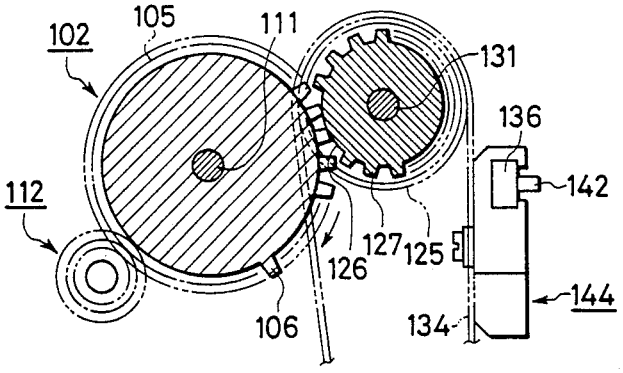
Figure 17:
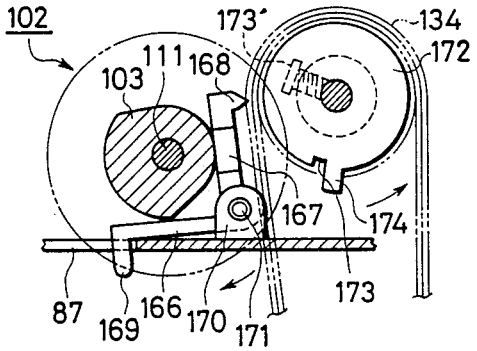

Reference numeral 102 denotes a rotary body. As illustrated in detail in FIG. 23, cam surfaces 103 and 104, a gear 105, and an engaging gear tooth 106 are integrally formed in accordance with this order around the outer periphery in the axial direction of the rotary body 102 from one side to the other side thereof, respectively. A groove cam 108 is formed in one end surface 107 of the rotary body 102. The rotary body 102 is rotatably attached in the following manner. Namely, as shown in FIG. 15, an attaching hole 109 of the rotary body 102 is directed to this side (in this diagram) of the side plate 73' and inserted to a projecting shaft 111 from this side (in FIG. 19) together with a seat 110. The gear 105 comes into engagement with the gear 101 of the rotary shaft 100 through conductive gears 112 attached to the side plate 73', so that the rotary body 102 is rotated by the rotation of the pulse motor 99.

Figure 23:
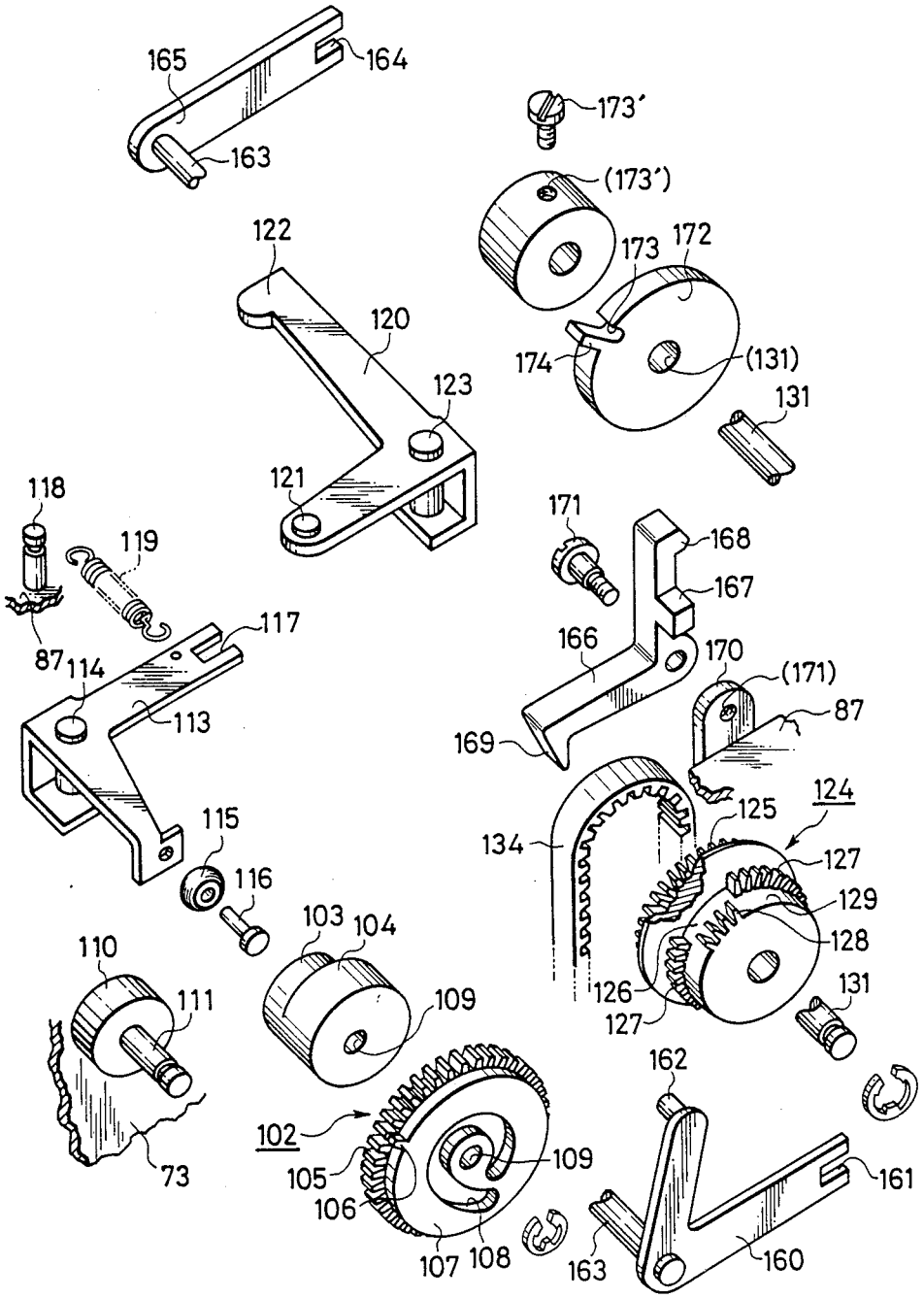

A first crank 113 is mounted over the metal fitting 87 so that it can freely swing by a shaft 114 as mainly illustrated in FIG. 23. A roller 115 adapted to come into engagement with the cam surface 104 of the rotary body 102 is rotatably attached to one end portion of the first crank 113 through a shaft 116, and an engaging notch 117 is formed in the other end of the first crank 113. A spring 119 is attached between the other end portion of the first crank 113 and a spring hook 118 attached on the metal fitting 87. The first crank 113 is urged by the tension of the spring 119 so that the roller 115 always comes into engagement with the cam surface 104 of the rotary body 102. A second crank 120 is mounted over the metal fitting 87 so as to swing around a shaft 123 in the state such that a pin 121 attached on one end portion of the second crank 120 is positioned in the notch 117 of the first crank 113 and the other end portion 122 is positioned between the pair of flanges $91_1$ and $91_2$ of the rotary shaft 86, respectively. When the pulse motor 99 rotates, the second crank 120 swings through the rotary body 102, first crank 113, and the like, so that the rotary shaft 86 can be slided in its axial direction by those sliding mechanisms As will be understood from the above description, the first and second cranks 113 and 120 receive the rotational force of the pulse motor 99 through the rotary body 102, transfer the rotational force to the shaft 86 to exchange the type wheel 12, allow the shaft 86 to slide in its axial direction, and thereby allow the type wheel to be sandwiched by the shaft 86 and bearing 97. Consequently, the first and second cranks 113 and 120, rotary shaft 86, bearing 97, and the like constitute the attaching/detaching means for coupling and removing the type wheel 12 with and from the motor 93.

Numeral 124 denotes a gear body. A gear 125 with a flange, a first partially toothless gear 127 which has a partially toothless portion 126, and a second partially toothless gear 129, which has only a tooth portion 128 at the position corresponding to the toothless portion 126, are formed on the gear body 124 in accordance with this order from one side to the other side of its axial direction, respectively. The gear body 124 is rotatably disposed between the side plates 73 and 73' so that the first gear 127 can engage the gear 105 of the rotary body 102 and the tooth portion 128 of the second gear 129 can engage the gear tooth 106 of the rotary body 102, respectively. Further, a gear 130 with a flange (refer to FIG. 12) which constitutes a pair together with the gear 125 with the flange is fixed to one end of a shaft 131. The gear body 124 is fixed to the shaft 131. A pair of timing belts 134 and 135 are set between the pair of gears 125 and 130 each having the flange and between a pair of gears 132 and 133 which are rotatably attached to the lower side portions of the side plates 73 and 73', respectively. When the gear body 124 rotates by the rotation of the rotary body 102, the pair of timing belts 134 and 135 can simultaneously vertically move by the same amount.

Figure 22:
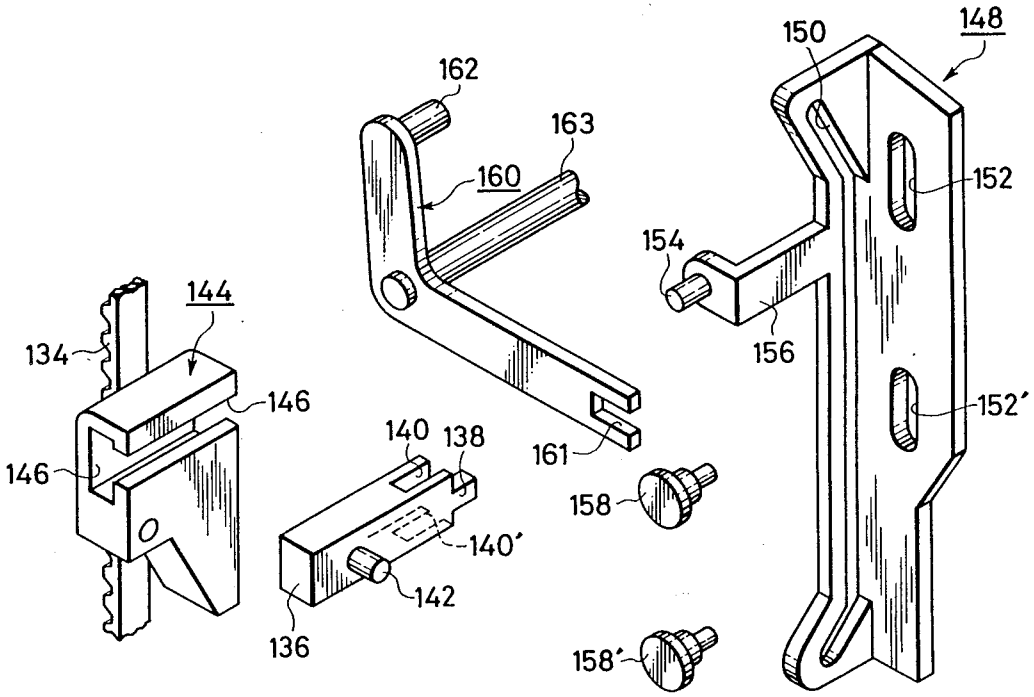

In FIG. 12, numerals 136 and 137 denote a pair of engaging bodies. As shown in FIG. 22, projections 138 and 139 and a pair of guide notches 140 and 140', and another pair of guide switches (not shown); are mainly formed in each end portion of the engaging bodies 136 and 137, respectively. Engaging pins 142 and 143 (not shown) are formed near the other end portion of one side (i.e., the end portion on this side on the right side in FIG. 22) of the engaging bodies 136 and 137. In FIG. 12, a pair of supporting members 144 and 145 are fixed to the timing belts 134 and 135, respectively. Grooves 146 (FIG. 22) and another groove (not shown), which enable the engaging bodies 136 and 137 to slide, are formed in the supporting members 144 and 145, respectively. The engaging bodies 136 and 137 come into engagement with the groove 146 and its companion groove, respectively. The pins 142 and 143 are inserted into guide groove portions of the grooves 146 and 147 and guided along these guide groove portions, respectively. In this manner, the engaging bodies 136 and 137 are supported by supporting members 144 and 145 so as to be slidable in the state such that these engaging bodies project from the supporting members 144 and 145, respectively.

Figure 21:
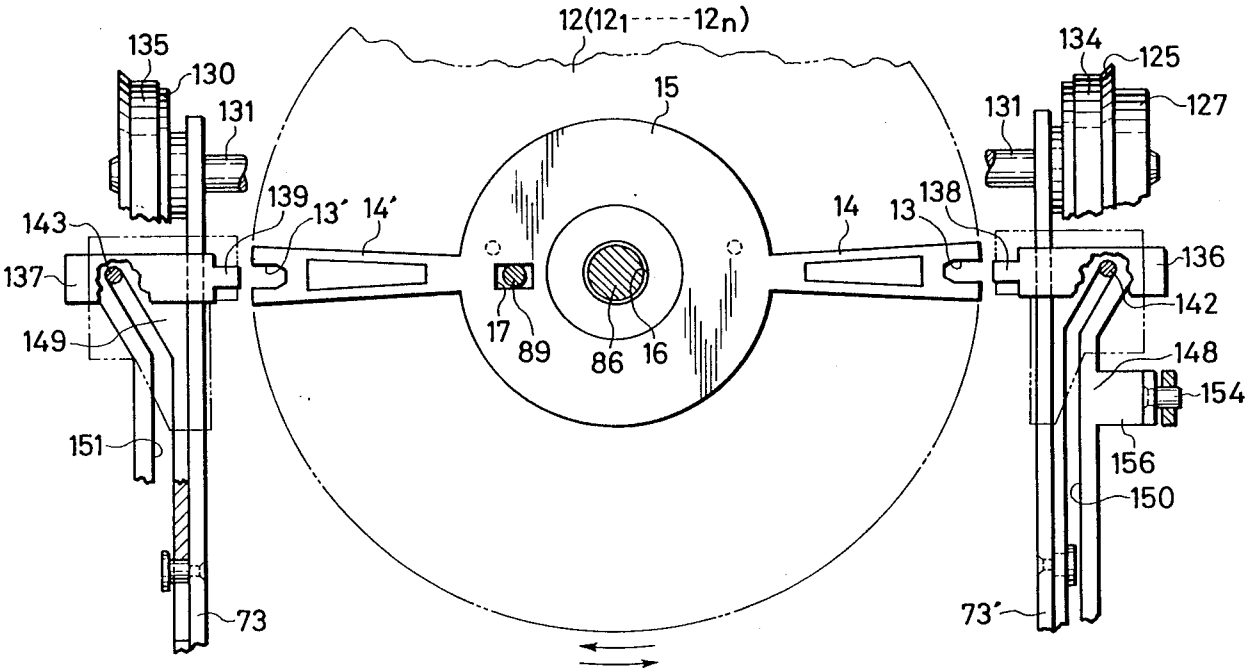

In FIG. 24, reference characters a and a' represent a pair of grooves to guide the engaging bodies 136 and 137, respectively. The grooves a and a' are formed in the side plates 73' and 73 of the carriage 3. In FIG. 21, numerals 148 and 149 indicate a pair of cam plates each of which has an almost ⅂-shaped cross section. Groove cams 150 and 151 each having substantially a ⌋-shape are formed on each side surface of the cam plates 148 and 149, respectively. A pair of attaching long holes 152 and 152', and another pair of attaching long holes (not shown) are formed in the other side surfaces of the cam plates 148 and 149, respectively, as illustrated in FIG. 22. Projecting portion 156 and another projection portion (not shown), having engaging pin 154 and another engaging pin (not shown), are formed on each side portion of the cam plates 148 and 149, respectively. Shafts (having flanges) 158 and 158', and 159 (not shown) and 159' (not shown) inserted into the long holes 152 and 152', and 153 and 153' of the cam plates 148 and 149 are fixed to the side plates 73' and 73 of the carriage 3 from the outside of these cam plates, respectively. The cam plates 148 and 149 are mounted over the side plates 73' and 73 so as to be slidable in the outsides of the side plates 73' and 73 by being guided by the engagements among the long holes 152, 152', 153, and 153' and the shafts (having flanges) 158, 158', 159, and 159', respectively.

In FIG. 22, numeral 160 denotes a crank. A notch 161 adapted to come into engagement with the pin 154 of the cam plate 148 is formed in one end portion of the crank 160, and a pin 162 adapted to come into engagement with the groove cam 108 of the rotary body 102 is formed so as to project from the other end portion. The crank 160 is fixed to one end portion of a rotary shaft 163 rotatably arranged between the side plates 73 and 73' of the carriage 3 in the state in which the notch 161 engages the pin 154 of the cam plate 148 and the pin 162 engages the groove cam 108 of the rotary body 102, respectively. As shown in FIG. 23, a lever 165 has at its one end a notch 164 adapted to come into engagement with the pin 155 of the cam plate 149. The other end of the lever 165 is fixed to the other end of the rotary shaft 163. The crank 160 swings by the rotation of the rotary body 102 due to the engagement between the groove cam 108 and the pin 162 of the crank 160 and at the same time, the lever 165 swings through the rotary shaft 163, thereby enabling the pair of cam plates 148 and 149 to slide. Further, as shown in FIG. 21, the pins 142 and 143 of the engaging bodies 136 and 137 supported by the supporting members 144 and 145 of the pair of timing belts 134 and 135 come into engagement with the groove cams 150 and 151 of the pair of cam plates 148 and 149, respectively. The engaging bodies 136 and 137 can slide by the engagement between the pins 142 and 143 and the groove cams 150 and 151, respectively.

In FIG. 23, a swing pawl lever 166 is formed like an almost ⅃-shape. A projection 167 adapted to come into engagement with the cam surface 103 of the rotary body 102 is projected from one side of the swing pawl lever 166. An engaging pawl 168 is formed at one end of the lever 166 and an urging dead weight 169 is formed at the other end, respectively. An ear portion 170 is vertically formed on the metal fitting 87 of the carriage 3. The lever 166 is attached to the ear portion 170 by a shaft screw 171 so as to swing in the state in which the projection 167 is in engagement with the cam surface 103 of the rotary body 102 by the urging force of the dead weight 169. Numeral 172 denotes a rotary disk to stop the pair of timing belts 134 and 135. A notch 173 is formed on a part of the peripheral surface of the rotary disk 172 and a projection 174 is also projectingly formed at the position close to the notch 173. The rotary disk 172 is fixed onto the shaft 131 by a screw 173' so as to be rotatable together with the gear body 124 in the state in which the rotary disk 172 is positioned inside of the side plate 73' of the carriage 3. When the rotary body 102 rotates, the lever 166 swings by the engagement between the cam surface 103 and the projection 167 of the lever 166, so that the pawl 168 comes into engagement with the notch 173 of the rotary disk 172, thereby allowing the gear body 124 to be temporarily retained through the rotary disk 172 and shaft 131. The movements of the timing belts 134 and 135 are temporarily stopped at those positions by the foregoing retaining mechanisms. In this state, the teeth of the gear 105 of the rotary body 102 are located in the toothless portion 126 of the first partially toothless gear 127. Therefore, even if the gear 105 rotates, the gear 105 will idle while the teeth of the gear 105 exist in the toothless portion 126, so that the rotational force will not be transferred to the gear body 124 or to the shaft 131. Next, when the rotary body 102 rotates in reverse, the lever 166 is returned due to the engagement between the cam surface 103 and the projection 167 of the lever 166. Thus, the temporary lock state of the gear body 124 by the rotary disk 172 and shaft 131 is released. At the same time, the tooth 106 of the rotary body 102 engages the tooth portion 128 of the second partially toothless gear 129 of the gear body 124, thereby allowing the gear body 124 to be rotated by the amount corresponding to the length of toothless portion 126. Thereafter, the teeth of the gear 105 again come into engagement with the first gear 127, so that the rotation of the rotary body 102 is transferred to the gear body 124 through the first gear 127, thereby allowing the gear body 124 and shaft 131 to be rotated. In this manner, the pair of timing belts 134 and 135 can be reciprocated.

Numeral 175 denotes a printing hammer which is attached to a shaft 177 through an attaching metal fitting 176 above the carriage 3. A solenoid 179 is attached to the carriage 3 through an attaching metal fitting 178. One end portion 175' of the hammer 175 swings toward the platen 2 by the operation of the solenoid 179, thereby printing on a print paper 181 set on the platen 2 through the type wheel 12 ($12_1, \ldots, 12_n$) and a ribbon 180.

The mechanical structure of the embodiment has been described in detail above. The main parts of the embodiment will now be described hereinbelow with respect to their functions for better understanding.

(Moving mechanism of the type wheel enclosing box)

A plurality of type wheels 12 are enclosed in the type wheel enclosing box (wheel magazine) 19 and this enclosing box is mounted on the carriage 3. The box 19 is guided by the shaft 71 and reciprocated in the direction perpendicular to the moving direction of the carriage 3, and a desired type wheel to be used is selected. The driving force to move the box 19 is applied from the pulse motor 72 and transferred to the rack 52 of the cradle 45 through the rotary shaft 74 and gear 74'. Thus, the cradle 45 is moved and the enclosing box 19 which is mounted integrally with the cradle 45 is also moved.

Lift-up/down mechanism of the type wheel

When the enclosing box 19 moves and the desired type wheel 12 is stopped at the pickup position due to the operation of the type wheel enclosing box moving mechanism, the engaging bodies 136 and 137 protrude so as to sandwich the type wheel 12 from both sides thereof as illustrated in FIG. 12, thereby engaging and supporting the type wheel 12. The engaging bodies 136 and 137 are respectively fixed to the timing belts 134 and 135 and vertically moved by the rotations of these belts, thereby allowing the sandwiched type wheel to be lifted up or down. The rotational force of the pulse motor 99 is transferred to the gears 112, 105, 127, and the like by the rotations of the timing belts 134 and 135. The engaging bodies 136 and 137 function not only to lift up the selected one of the type wheels 12 in the enclosing box 19 to the type wheel detachable position but also to lift down the type wheel at the type wheel detachable position to the box 19.

As will be also understood from FIG. 12, the embodiment has the characteristic constitution such that the type wheels existing at the enclosing position and the type wheel existing at the detachable position are arranged so as to partially overlap with each other. In order to realize such an overlap arrangement that the type wheels at those positions overlap each other as mentioned above, it is sufficient to set the distance between both positions to be smaller than the diameter of each type wheel 12. With this arrangement, the moving distance of the type wheel upon exchanging thereof is reduced, resulting in an improvement of the exchanging speed. Further, the height of whole carriage can be reduced, so that this arrangement is extremely effective to reduce the size of and miniaturize the printer. In such an arrangement in which the type wheels existing at both positions partially overlap with each other, it is considered that when the enclosing box 19 moves, the type wheel existing at the detachable position may collide. However, no problem will be caused since when the enclosing box 19 moves, the type wheel existing at the detachable position is certainly previously enclosed in the box 19.

Engaging/disengaging mechanism of the engaging bodies and type wheel

As described in the lift-up/down mechanism of the above item, the engaging bodies 136 and 137 protrude toward or are removed from contact with the type wheel 12, thereby engaging and supporting the type wheel 12 or being disengaging therefrom. Such projection and removal of the engaging bodies 136 and 137 are realized by the operations of the cam plates 148 and 149 and the crank 160 adapted to be come into engagement with the groove cam 108 of the rotary body 102 as shown in FIG. 12. The groove cams 150 and 151 are formed in the cam plates 148 and 149 and parts of the engaging bodies 136 and 137 are inserted into the groove cams 150 and 151, respectively. As will be also obviously understood from the drawings, the upper and lower end portions of the groove cams 150 and 151 are outwardly bent, respectively. When the cams 150 and 151 are guided by these bent portions, the engaging bodies 136 and 137 move backwardly to the positions where they disengage from the type wheel 12, respectively. Therefore, as the engaging bodies 136 and 137 are moved upwardly from the lower ends of the groove cams 150 and 151, the engaging bodies 136 and 137 respectively protrude in the direction of the type wheel at the position where the type wheels are enclosed, thereby engaging and supporting this type wheel with their rotation restricted and then lifting up the type wheel. When the type wheel is lifted up to the detachable upper end position, the engaging bodies 136 and 137 are arranged at the positions just before the bent portions of the groove cams 150 and 151. When the rotary body 102 further rotates from this position, the crank 160 puts down the cam plates 148 and 149, so that the engaging bodies 136 and 137 run on the bent portions of the groove cams 150 and 151 and thereafter, they move backwardly from the type wheel and disengage therefrom.

Coupling mechanism between the type wheel and the wheel motor

Figure 19:
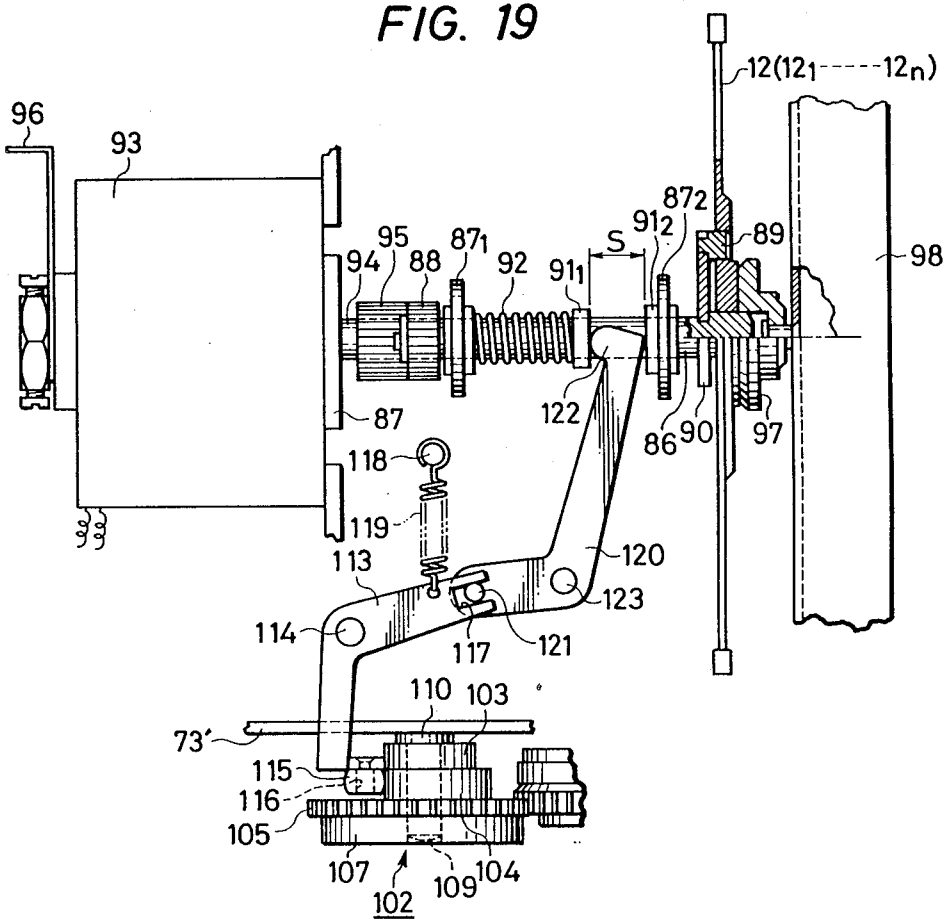
Figure 20:
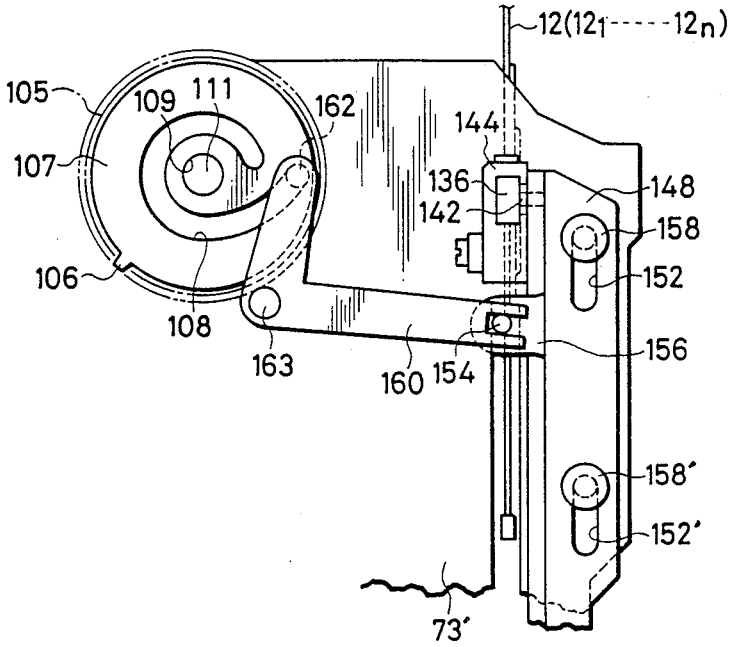

After the type wheel 12 was moved to the detachable position by the type wheel lift-up/down mechanism mentioned above, it is coupled with the pulse motor 93 as the wheel motor at that position. Speaking in more detail, as shown in FIG. 19, when the rotary body 102 rotates by the rotational force of the pulse motor 99, the first crank 113 abutting on the cam surface 103 of the rotary body 102 rotates around the shaft 114 as a rotational center and in association with this, the second crank 120 also rotates. The other end portion 122 of the second crank 120 allows the rotary shaft 86 to slide in its axial direction. In the case of coupling the type wheel 12 with the pulse motor 93, the rotary shaft 86 is allowed to slide in the direction of the bearing 97 to sandwich the type wheel 12. To release the coupling between the type wheel 12 and the pulse motor 93, the rotary shaft 86 is allowed to slide so as to be away from the bearing 97. The sliding direction of the rotary shaft 86 as mentioned above is determined by the rotational direction of the rotary body 102, i.e., the rotational direction of the pulse motor 93.

Among the foregoing respective mechanisms, the lift-up/down mechanism, engaging/disengaging mechanism, and coupling mechanism are all driven by the rotational force of the pulse motor 93 and their operation timings are determined by the rotary body 102.

Figure 18:
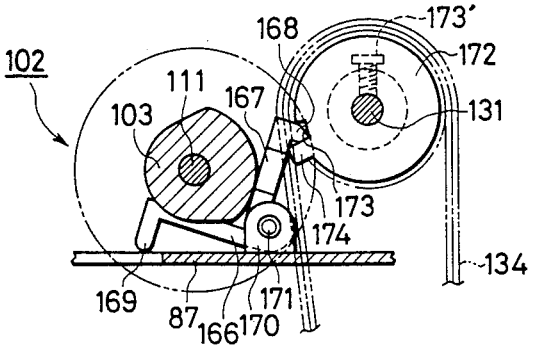
Figure 26:
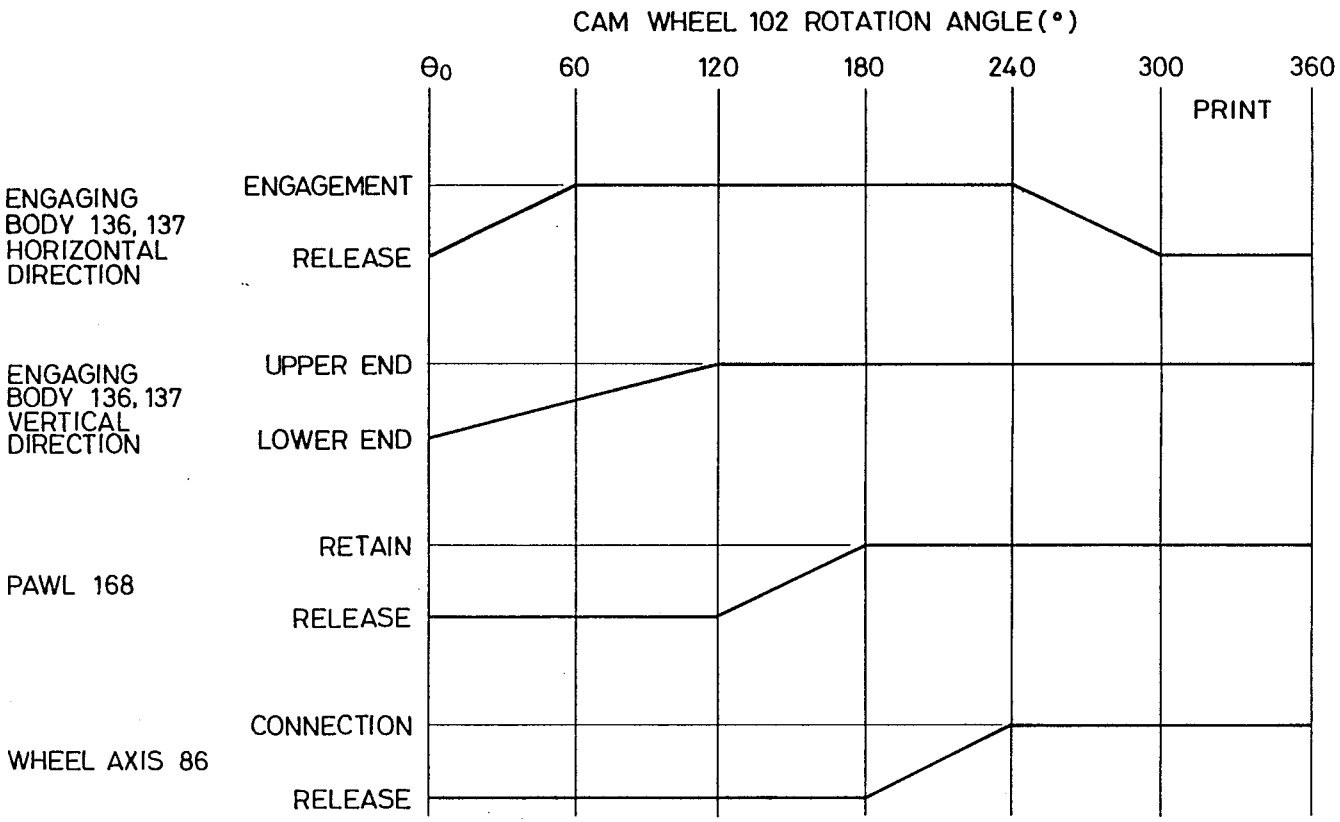

FIG. 26 shows operation timings of the respective mechanisms using the rotation angle of rotary body 102 as a parameter. As will be understood from this timing chart, as the rotary body 102 forwardly rotates, the engaging bodies 136 and 137 first ascend and thereafter, the engaging bodies 136 and 137 soon sandwich the selected one of the type wheels 12 in the enclosing box 19. Further, the type wheel 12 is lifted up to the detachable position, which is the upper end position. When the type wheel 12 reaches the detachable position, the pawl 168 rotates to accurately fixed the engaging bodies 136 and 137 to the stop position and is inserted into the notch 173 of the rotary disk 172 as shown in FIG. 18. Next, the rotary shaft 86 to rotate the type wheel is protruded toward the bearing 97, thereby connecting the type wheel 12 with the pulse motor 93. Thereafter, the engaging bodies 136 and 137 move backwardly from the type wheel 12 and disengage therefrom. The type wheel can be removed by rotating the pulse motor 93 in reverse and by executing the operations opposite to the above-mentioned operations.

The initial position of the rotary body 102, which plays the central role in the foregoing sequence, is detected by a sensor C shown in FIG. 5. The sensor C detects the operating member of the shaft 131 and senses the initial position.

Figure 27:
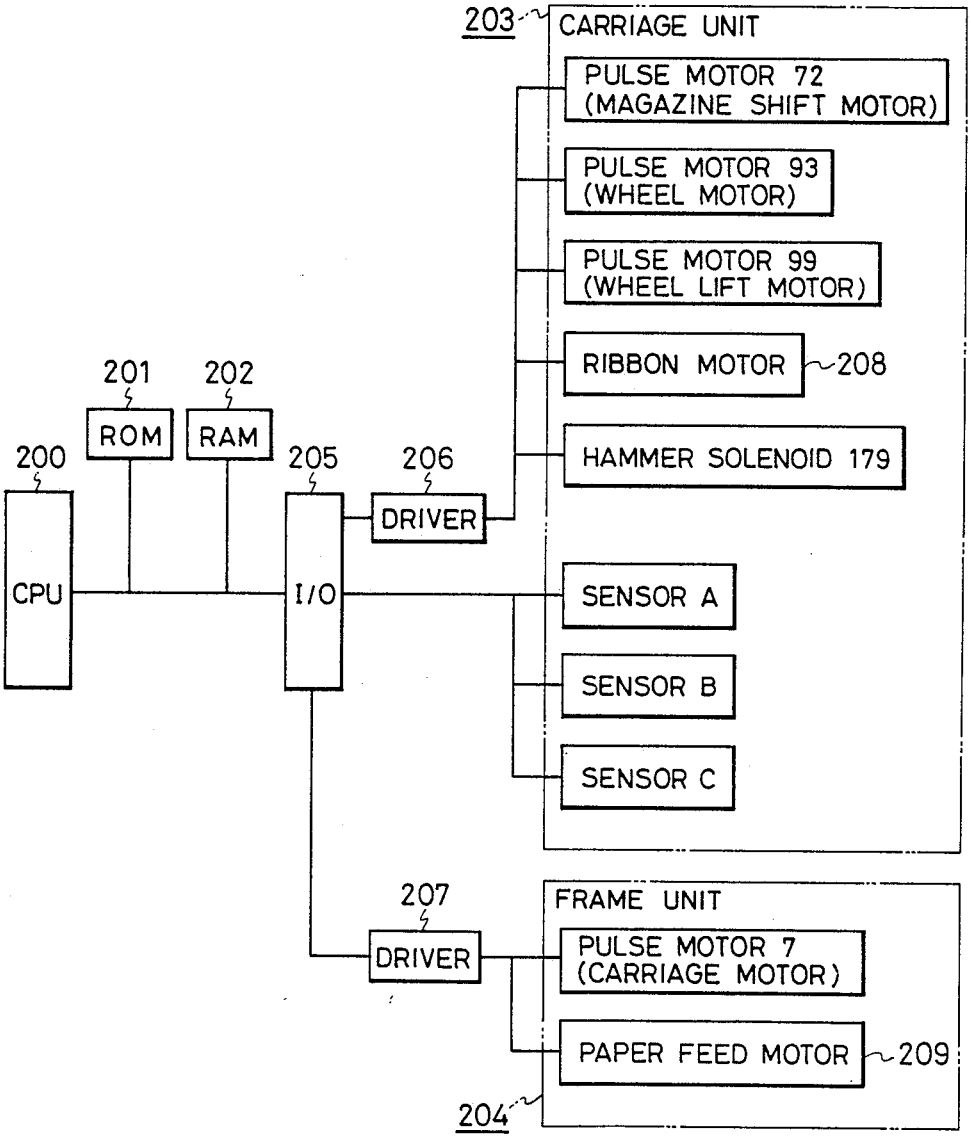

FIG. 27 shows a block circuit diagram of the embodiment. The printer in this embodiment is controlled by a central processing unit (hereinafter, abbreviated as a CPU) 200. The content of the control is previously stored as a program in a ROM 201. On the other hand, the print data of one line or one page or the like to be printed is stored in a RAM 202. The RAM 202 also serves as a rewritable memory to sequentially rewritably store various states of the respective sections of the printer.

The printing mechanism of the printer is fundamentally constituted by a carriage unit 203 and a frame unit 204. The units 203 and 204 are controlled by the CPU 200 through an interface circuit 205 by way of drivers 206 and 207, respectively. The carriage unit includes the foregoing pulse motor 72 (to move the wheel magazine), the pulse motor 93 (wheel motor), the pulse motor 99 (to lift up and couple the wheel), an ink ribbon feed motor 208, the hammer solenoid 179, and the like. In addition, the carriage unit 203 also includes: the sensor A to detect the home position of the type wheel enclosing box 19; the sensor B to detect the home position of the pulse motor 93 as the wheel motor; and the sensor C to detect the home position of the rotary body 102.

On the other hand, the frame unit 204 includes the pulse motor 6 to move the carriage and a paper feed motor 209 to feed the print paper wrapped on the platen.

Figure 28:
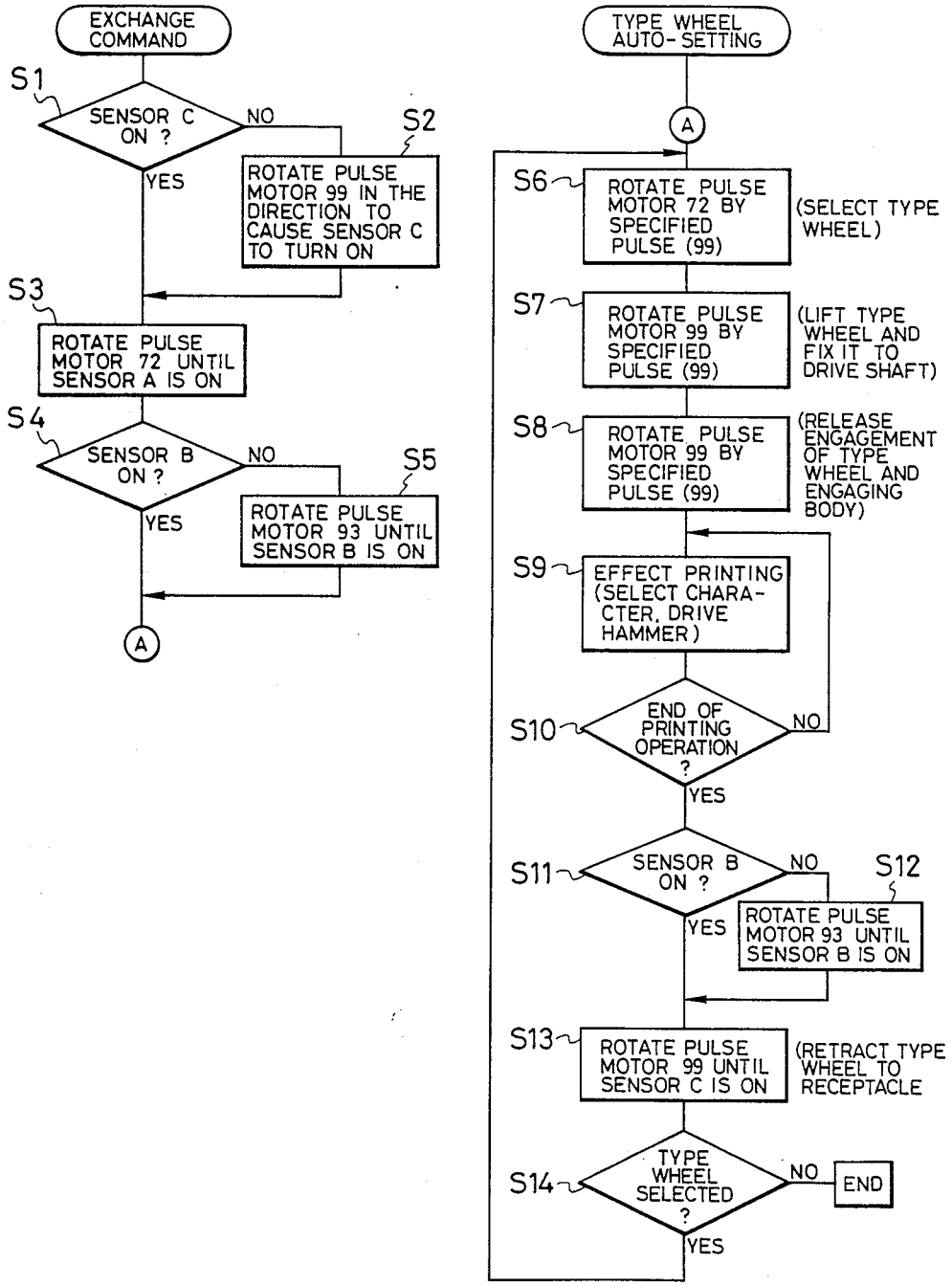

The operation of the printer will now be described with reference to a flowchart shown in FIG. 28. The operating program according to this flowchart is stored in the ROM 201.

Figure 4:
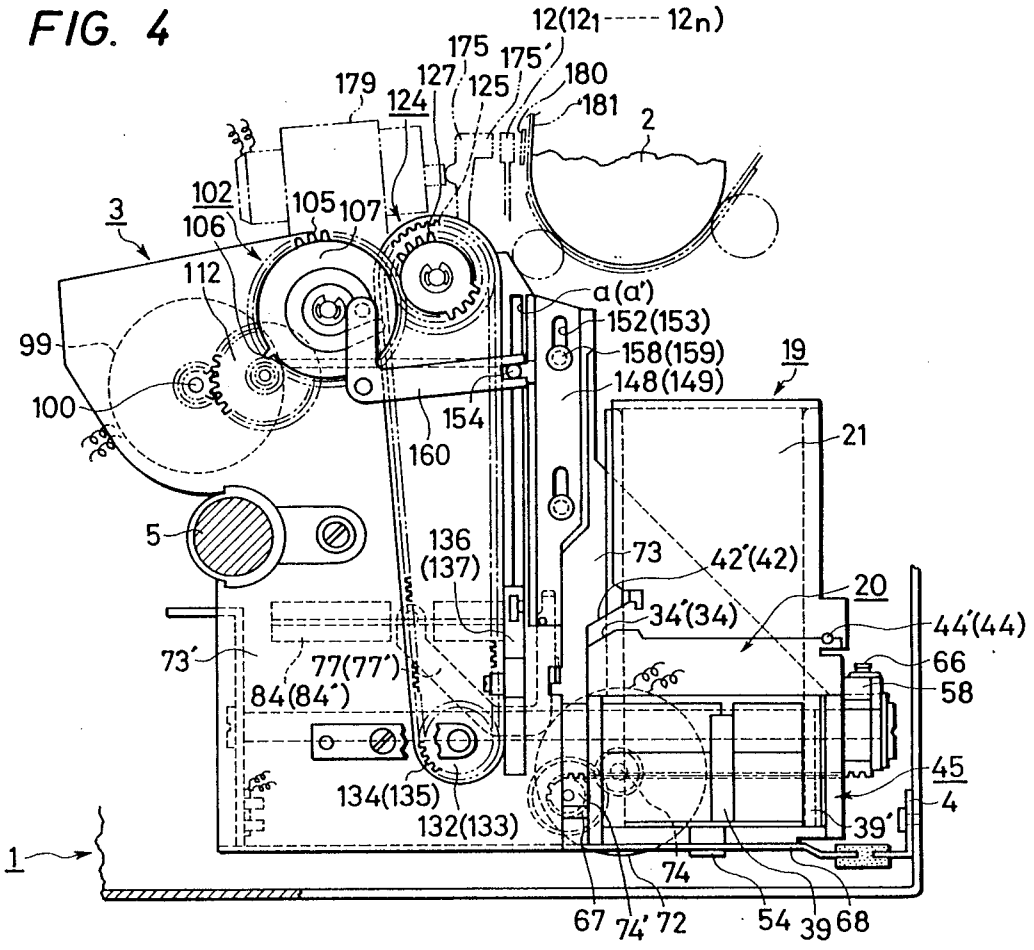

As shown in FIGS. 4 and 5, as the initial state, it is assumed that the enclosing box 19 in which a number of type wheels 12 ($12_1, \ldots, 12_n$) different in character type, size or sort are enclosed and the cradle 45 are mounted on the carriage 3 attached to the printer chassis 1 so as to be movable by the rotation of the pulse motor 72.

In this state, a command is given to the CPU 200 so as to set a desired one of the type wheels 12 at the position adapted to print. In response to this command, the CPU 200 checks to determine if the rotary body 102 exists at the home position or not by detecting whether the sensor C has been turned on or not in step S1. If the rotary body 102 is not at the home position, in step S2, the pulse motor 99 is rotated until the sensor C is turned on, thereby setting the rotary body 102 to the home position. In the next step S3, the pulse motor 72 is rotated to move the enclosing box 19 and cradle 45 to the home position where the operating member 67 comes into engagement with the sensor A attached to the carriage 3. (In this case, mainly as shown in FIGS. 8 to 11, the engaging bodies 77 and 77' swing due to the engagement between the cam surfaces 34' and 34 of the cover 21 and the pins 80 and 80' of the engaging bodies 77 and 77' provided for the carriage 3, so that the projections 79 and 79' engage the notches 43' and 43 of the cover 21 and press the cover 21.) Thus, the elastic engagements between the pins 44 and 44' of the cover 21 and the recesses 37 and 37' of the box 20 are released and the cover 21 moves upwardly while gradually opening the upper portion of the enclosing box 19. The respective notches 13 and 13' of the type wheels 12 ($12_1, \ldots, 12_n$) slightly come into engagement with the projections 138 and 139 of the engaging bodies 136 and 137 attached to the timing belts 134 and 135 and move. Thereafter, the notches 13 and 13' come into engagement with the stop members 84 and 84'.)

In steps S4 and S5, the pulse motor 93 is rotated until the sensor B is turned on. Thus, the rotary shaft 86 to rotate the type wheel is set to the position where the projection 89 can be come into engagement with the retaining hole 17 when the type wheel is lifted up to the detachable position.

Next, the pulse motor 72 is rotated in reverse by the control command from the CPU 200 to return the enclosing box 19 together with the cradle 45, thereby setting a desired type wheel in the enclosing box 19 to the position where the notches 13 and 13' of this type wheel slightly engage the projections 138 and 139 of the engaging bodies 136 and 137 (step S6). (This state is illustrated in FIG. 12.) Next, by rotating the pulse motor 99, the rotary body 102 rotates through the gear 101 and conductive gears 112. The rotational force of the rotary body 102 is transferred to the shaft 131 through the gear 105 and first gear 127 of the gear body 124, thereby rotating the flanged gears 125 and 130. The pair of timing belts 134 and 135 are moved in the direction indicated by arrows in FIG. 12 together with the supporting members 144 and 145 and engaging bodies 136 and 137. Thus, the pins 142 and 143 of the engaging bodies 136 and 137 engage the groove cams 150 and 151 of the cam plates 148 and 149, thereby allowing the projections 138 and 139 of the engaging bodies 136 and 137 to completely come into engagement with the notches 13 and 13' of the type wheel. The type wheel is lifted up to the position so as to face the rotary shaft 86 and bearing 97 with the attaching hole 16 sandwiched between the rotary shaft 86 and bearing 97. At the same time, the rotation of the gear 105 of the rotary body 102, which will be transferred to the shaft 131 through the first partially toothless gear 127, is not transferred because of the toothless portion 126 of the first gear 127. The pawl 168 of the swing pawl lever 166 engages the notch 173 of the rotary disk 172 due to the engagement between the cam surface 103 of the rotary body 102 and the projection 167 of the lever 166. The gear body 124 is rotated by the shaft 131 and stops the movement of the timing belts 134 and 135, thereby allowing the type wheel to be temporarily stopped at the foregoing position. In this state, the second crank 120 swings due to the engagement between the cam surface 104 of the rotary body 102 and the roller 115 of the first crank 113, thereby allowing the rotary shaft 86 to swing toward the bearing 97 together with the retaining member 90. Thus, the rotary shaft 86 and projection 89 of the retaining member 90 come into engagement with the attaching hole 16 of the type wheel and with the retaining hole 17, respectively. In this manner, the type wheel is fixed to the rotary shaft 86. (Step S7)

Next, the crank 160 swings due to the engagement between the groove cam 108 of the rotary body 102 and the pin 162 of the crank 160 immediately after the type wheel is fixed to the rotary shaft 86. The lever 165 swings by the rotary shaft 163. The pair of cam plates 148 and 149 are moved in the directions indicated by arrows in FIG. 15 due to the engagement between the long holes 152 and 152' and the shafts 158 and 158'. The engaging bodies 136 and 137 are moved by the engagement between the groove cams 150 and 151 of the cam plates 148 and 149 and the pins 142 and 143 of the engaging bodies 136 and 137. Thus, the projections 138 and 139 disengage from the notches 13 and 13' of the type wheel, thereby attaching the type wheel to the rotary shaft 86 in the rotatable state adapted to perform the printing operation. (Step S8) (The operating states in this step are shown in FIGS. 15 to 21.)

In this state, the operating member 96 is located at the position of the sensor B and the shaft 94 of the pulse motor 93 and type wheel are located at the home positions in the rotational direction. Therefore, the pulse motor 93 is driven and the solenoid 179 is made operative by the control commands from the CPU 200 in this state, thereby allowing a desired character to be printed by the type wheel. (steps S9 and S10)

After completion of the print by the type wheel, another control command is generated from the CPU 200 for exchange the type wheel to another wheel. In response to this command, the pulse motor 93 is driven to displace the rotary shaft 94 of the pulse motor 93 and the type wheel to the home positions in the rotational direction (steps S11 and S12). Thereafter, the pulse motor 99 is rotated in reverse to rotate the rotary body 102 in reverse. The crank 160, rotary shaft 163, and lever 165 are made operative in the directions opposite to the foregoing directions, respectively, thereby moving the cam plates 148 and 149 in the direction opposite to the foregoing direction. The projections 138 and 139 of the engaging bodies 136 and 137 come into engagement with the notches 13 and 13' of the type wheel, respectively. Thereafter, the engaging gear tooth 106 of the rotary body 102 soon comes into engagement with the tooth portion 128 of the second partially toothless gear 129 of the gear body 124, thereby allowing the gear body 124 to be rotated in the direction opposite to the foregoing direction. Thus, the temporary retaining state of the pair of timing belts 134 and 135, namely, the type wheel by the pawl 168 of the swing pawl lever 166 through the rotary disk 172 and shaft 131 is released. At the same time, the first gear 127 of the gear body 124 comes into engagement with the gear 105 of the rotary body 102 and is rotated. The timing belts 134 and 135 are rotated in reverse. Thus, the type wheel is returned in the enclosing box 19 through the engaging bodies 136 and 137. Thereafter, the timing belts 134 and 135 are returned to disengage the engaging bodies 136 and 137 from the notches 13 and 13' of the type wheel, thereby allowing the type wheel to be completely enclosed into the enclosing box 19. (Step S13) The sensor C is arranged at the position so as to be turned on when the engaging bodies 136 and 137 descend to the lowest positions by the timing belts 134 and 135.

If it is determined that the type wheel to be attached exists (step S14), the respective sections are made operative in a manner similar to the above. The type wheel to be exchanged is attached to the rotary shaft 86 in the state adapted to perform the printing operation.

(Another embodiment)

FIGS. 29 to 39 show another embodiment of the present invention. This embodiment is constituted substantially in the same manner as the foregoing first embodiment except for the following points.

(1) In the first embodiment, the type wheel is exposed and moved with a part of the wheel engaged and supported. However, in the second embodiment, the type wheel is enclosed in a cassette casing and this casing is supported and the type wheel is moved.

(2) In the first embodiment, the type wheel is supported in an engagement relation at the position of a specific angle and moved to the detachable position. Therefore, when the type wheel reaches the detachable position, the type wheel has already been set to the position where it can be directly coupled with the rotary shaft of the wheel motor. On the other hand, in the second embodiment, the type wheel is enclosed in the cassette casing and is moved to the detachable position with the casing sandwiched. Therefore, the type wheel is not always set to the proper angular position such that the wheel can be coupled with the rotary shaft of the wheel motor at the detachable position. Therefore, in the second embodiment, it is necessary to provide a mechanism that performs such that after the type wheel is moved to the detachable position, the wheel motor is rotated to set the type wheel to the proper angular position so that it can be accurately coupled with the rotary shaft of the wheel motor.

(3) In the first embodiment, the type wheel directly comes into engagement and is supported by the pair of engaging bodies, so that when the type wheel is rotated, the engagement of the type wheel by the engaging bodies must be certainly released. On the other hand, in the second embodiment, the cassette casing comes into engagement and is supported by the engaging bodies, while the type wheel is moved to the detachable position in this state. Therefore, when the type wheel is rotated as well, there is no need to disengage the engaging bodies from the cassette casing. Consequently, in the second embodiment, the engaging bodies also engage and support the cassette casing during the printing operation.

(4) In the first embodiment, the rotary shaft to be directly coupled with the type wheel is different from the output shaft of the wheel motor, and the type wheel is coupled with and removed from the wheel motor by moving only the rotary shaft. On the other hand, in the second embodiment, the type wheel is coupled with and removed from the output shaft of the wheel motor by moving the entire wheel motor.

The second embodiment will now be described with reference to the drawings.

In FIG. 29, a platen 301 is rotatably attached to a well-known printer chassis (not shown). A carriage 302 is also mounted over the printer chassis so as to be slidable in the lateral direction in FIG. 30. As shown in detail in FIG. 31, a daisy type wheel 303 is constituted in a manner such that type portions 304 are formed at the edge portions of the spokes radially formed thereon. Numeral 305 denotes a boss of the daisy type wheel 303; 305' is an engaging hole formed at a predetermined position (home position) in the boss 305; 306 a boss hole; 307 an elastic wire for engagement which is attached toward the boss hole 306 from the boss 305; and 308 a cassette casing to enclose the type wheel 303. The casing 308 has an almost ⌊-shaped cross section. As shown in FIG. 30, the cassette casing 308 comprises a front side plate 312 and a rear side plate 321. The front side plate 312 comprises: a boss 310 having a boss hole 309; and a notch 311 communicating with the boss hole 309. The rear side plate 321 comprises: a notch 314 adapted to insert a print hammer 313 (FIG. 29) which has an almost ⌋-shaped cross section and is attached to the carriage 302 at substantially the central position of the upper edge portion; operating members 315 and 316 (FIG. 31) arranged on both sides of the notch 314; a boss 318 having a boss hole 317 (FIG. 29) at substantially the central position; and a pair of engaging notches 319 and 320 (FIG. 31) formed in both side edge portions on substantially the center line of the boss hole 317. The boss 305 of the type wheel 303 comes into engagement with the boss hole 309 of the front side plate 312. Thereafter, the front and rear side plates 312 and 321 are integrally assembled. Thus, the type wheel 303 is rotatable in an enclosing groove 322 formed between the front and rear side plates 312 and 321 and at the same time, the wheel 303 is enclosed in the cassette casing 308 so as not to be removed.

In FIG. 29, a plurality of cassette casings 308, in each of which a type wheel 303 is enclosed, are enclosed into an enclosing box 323. The upper portion of the enclosing box 323 is open to form a space 324. A plurality of cassette casings 308, in each of which a type wheel 303 is enclosed, are enclose in the space 324 so as to be movable upwardly, respectively. Numeral 325 indicates an enclosing cradle of the enclosing box 323. This cradle is mounted onto the carriage 302 so as to be movable in the lateral direction in FIG. 29 through a shaft 326 attached to the carriage 302, a pulse motor 327, gears 328, a rack 329 provided for the enclosing cradle 325, and the like. Therefore, when the enclosing box 323 in which a plurality of cassette casings 308, each containing the type wheel 303 are enclosed, is mounted on the enclosing cradle 325, the pulse motor 327 is rotated by a control signal from a cóntroller (not shown), thereby moving the enclosing box 323 together with the cradle 325. Thus, a desired one of a plurality of type wheels 303 can be moved together with its cassette casing 308 to a predetermined position, which will be explained in detail hereinafter. The type wheel 303 is rotated by a drive motor 330. A base plate 336 has: engaging ear portions 331, 331', 332, and 332' at four corners so as to be projected outwardly; a hole 333 adapted to enclose the drive motor 330 at substantially the central position; and an attaching portion 334 formed by upwardly bending. A part of the drive motor 330 is downwardly inserted into the hole 333 and the motor 330 is attached to the attaching portion 334 by screw nuts 335 and fixed onto the base plate 336. The ear portions 331, 331', 332, and 332' of the base plate 336 come into engagement with a pair of guiding long holes 338 and 338' formed in the upper end portions of both side plates 337 and 337' of the carriage 302. The drive motor 330 is mounted to the carriage 302 so as to be movable together with the base plate 336 in the lateral direction in FIG. 29 by being guided due to the engagements between the long holes 338 and 338' and the ear portions 331, 331', 332, and 332', respectively. Reference numeral 339 denotes a drive shaft of the drive motor 330; 340 is an operating member fixed to the rear end portion (left end portion in FIG. 29) of the drive shaft 339; and 341 is a sensor attached to the base plate 336. When the operating member 340 is located at the position of the sensor 341, a predetermined position (home position) of the drive shaft 339 is detected, so that a detection signal is generated from the sensor 341. A motor 342 is provided to move the drive motor 330 (accordingly, base plate 336). The motor 342 is fixed through an attaching metal fitting 343 to the outside (left side in FIG. 30) of the side plate 337 of the carriage 302. Numeral 344 represents a cam plate. A conductive gear 345 is attached to one side surface of the cam plate 344 and a groove cam 346 is attached to the other side surface (right side in FIG. 30), respectively. An engaging projection 347 is formed on a part of the outer peripheral surface of the cam plate 344. The cam plate 344 is rotatably attached through a shaft 348 to the inside (right side in FIG. 30) of the side plate 337. The cam plate 344 and motor 342 are coupled through a gear 349 attached to a rotary shaft 342' of the motor 342 and through the gear 345. Thus, the cam plate 344 can be rotated by the rotation of the motor 342. A pin 351 adapted to come into engagement with the groove cam 346 of the cam plate 344 is projectingly formed at one end of a crank 350, and an engaging notch 352 is formed in the other end portion. When the pin 351 is in engagement with the groove cam 346, the crank 350 is fixed by a screw nut 354 at the location near one end (left end in FIG. 30) of a rotary shaft 353 attached between the side plate 337 and 337' of the carriage 302. One end of a swing lever 355 is fixed by a screw nut 356 at the location near the other end (right end in FIG. 30) of the rotary shaft 353. An engaging notch 357 is formed in the other end portion of the swing lever 355.

In FIG. 30, numerals 358 and 358' denote a pair of engaging pins which are outwardly formed from a pair of ear portions 359 and 359', respectively. The ear portions 359 and 359' are formed by upwardly (forwardly in FIG. 29) bending partial side edges of almost central portions in the forward and backward directions of the base plate 336, respectively. The pin 358 engages the notch 352 of the crank 350. The pin 358' engages the notch 357 of the swing lever 355. Therefore, when the motor 342 rotates, the cam plate 344 is rotated through the gears 349 and 345, so that the groove cam 346 comes into engagement with the pin 351 and the crank 350 swings. When the crank 350 swings, the swing lever 355 also swings through the rotary shaft 353, thereby enabling the drive motor 330 to be moved together with the base plate 336 in the lateral direction in FIG. 29. An annular groove 360 adapted to come into engagement with the elastic wire 307 of the boss hole 306 of the type wheel 303 and a disk portion 362 having a notch 361 at the position corresponding to a predetermined position (home position) of the drive shaft 339 are formed in the front end portion (right end portion in FIG. 29) of the drive shaft 339 of the drive motor 330 from the front end portion toward the rear end portion in accordance with this order, respectively. An elastic plate 364 having an engaging member 363 is fixed by a screw 365 to the back side surface (left side surface in FIG. 29) of the disk portion 362 in a manner such that the engaging member 363 pierces through the notch 361 and is projected from the front side surface (right side surface in FIG. 29) of the disk portion 362 due to the elasticity of the elastic plate 364. Numeral 366 denotes a partition plate and 367 (FIG. 30) indicates a notch formed in the upper portion (forward portion in FIG. 29) of the central portion in the lateral direction (in FIG. 29) of the partition plate 366. The notch 367 is located to be directed upward (to the forward portion in FIG. 29). In this state, the partition plate 366 is located slightly in front of the drive shaft 339 of the drive motor 330 and fixed between the side plates 337 and 337' of the carriage 302. Numeral 368 denotes a partition metal fitting having an ⌊-shaped cross section. The metal fitting 368 is fixed between the side plates 337 and 337' of the carriage 302 with a clearance left between a vertical projecting portion 369 of the metal fitting 368 and the partition plate 366. This clearance has such a size that the type wheel 303 enclosed in the cassette casing 308 can pass through this clearance together with the cassette casing 308. A hole 370 is formed in the vertical projecting portion 369 at the position opposite to a predetermined position (home position) of the engaging member 363 attached to the drive shaft 339 of the drive motor 330.

In FIG. 29, an engaging pin 371 is vertically formed on one side (left side near the front side portion in FIG. 30) near the front side portion of the base plate 336. A first swing lever 372 is attached to a shaft 374 attached near the left end portion (in FIG. 30) of a horizontal surface 373 of the metal fitting 368 in FIG. 30. The first swing lever 372 is urged so as to always swing in one direction (counterclockwise in FIG. 30) by the tension of a spring 376 attached between a spring hook 375 and the side plate 337 of the carriage 302. An engaging projection 377 which is formed by downwardly (in the direction of the back of paper in FIG. 30) bending is formed at one end portion of the first swing lever 372. An actuating lever 379 has at one end a ⌈-shaped engaging portion 378 adapted to come into engagement with the pin 371 of the base plate 336 by piercing through a long hole 338" formed in the side plate 337 of the carriage 302. The other end of the lever 379 is connected by a shaft 380 at the position below the other end of the lever 372. A second swing lever 381 is located below (on the back side of the paper in FIG. 30) the first swing lever 372 and attached to the shaft 374. The second lever 381 is urged so as to always swing in one direction (clockwise in FIG. 30) by the tension of a spring 384 attached between a spring hook 382 and a spring hook 383 formed on the horizontal surface 373 of the metal fitting 368. An engaging projection 385 is formed at one end of the second lever 381. A swing lever 386 is attached to the rotary shaft 353 and one end of the lever 386 comes into engagement with the projection 347 of the cam plate 344. The other end of the lever 386 pierces through a long hole 338''' formed in the side plate 337 and is located in the outside of the long hole 338''' and coupled with the other end of the second swing lever 381 through a connecting lever 387. The second lever 381 can be allowed to swing through the connecting lever 387 against the urging force of the spring 384 due to the swing of the swing lever 386 by the engagement between the projection 347 of the cam plate 344 and one end of the lever 386. The tension of the spring 376 to urge the first swing lever 372 is larger than that of the spring 384 to urge the second swing lever 381. Thus, the first swing lever 372, which is applied with the tension of the spring 376, can make the second swing lever 381 swing through the projection 377 against the urging force of the spring 384 until a projecting portion 388 formed on one side (forward side in FIG. 30) of the second swing lever 381 collides with the spring hook 383 and is stopped by this hook. When the first swing lever 372 is caused to swing against the urging force of the spring 376, the second swing lever 381 then swings by the tension of the spring 384 in association with the swing of the first swing lever 372. A pair of swing levers 389 and 390 are attached to the side plates 337 and 337' of the carriage 302, respectively. Due to the swinging motions of the swing levers 389 and 390, a selected one of the type wheels 303 in the enclosing box 323 which has been moved to a predetermined position of the carriage 302 can be lifted up together with the cassette casing 308 to the predetermined position where the boss hole 306 faces the drive shaft 339 of the drive motor 330 or can be returned into the enclosing box 323 through engaging bodies 395 and 396. The engaging bodies 395 and 396 have projections 393 and 394 adapted to be inserted into long holes 391 and 392 formed in each end portion of the swing levers 389 and 390 and to come into engagement with the pair of notches 319 and 320 of the cassette casing 308, respectively.

FIGS. 29 and 30 show the state in which one side of the type wheel 303 in the enclosing box 323 is located together with the casing 308 at the predetermined position where the boss hole 306 of this wheel faces the drive shaft 339 of the drive motor 330, the operating member 340 is located at the position of the sensor 341, the drive shaft 339 is stopped at the predetermined position (home position), and at the same time the type wheel 303 is not attached to the drive shaft 339. In this state, the rotary shaft 342' of the motor 342 is rotated by a control signal from a controller (not shown), so that the cam plate 344 rotates, the crank 350 swings, and the swing lever 355 swings through the rotary shaft 353. Thus, the base plate 336 and drive motor 330 together with the drive shaft 339 are moved toward the type wheel 303. The annular groove 360 of the drive shaft 339 is come into engagement with the elastic wire 307 of the boss hole 306 of the type wheel 303. The pin 371 of the base plate 336 comes into engagement with the engaging portion 378 of the actuating lever 379, thereby causing the first lever 372 to swing through the lever 379 against the urging force of the spring 376. Thus, as mentioned above, the second swing lever 381 swings by the tension of the spring 384. The projection 385 pierces through the hole 370 of the partition metal fitting 368 and through the notch 311 of the casing and comes into engagement with the boss 305 of the type wheel 303. When the engaging hole 305' of the type wheel 303 is located at a predetermined position (home position) of the drive shaft 339, the projection 385 engages the engaging hole 305', thereby allowing the type wheel 303 to be temporarily stopped at that position. At the same time, the engaging member 363 comes into engagement with the engaging hole 305' of the type wheel 303 in place of the projection 385 by the elastic force of the elastic plate 364. Thus, the type wheel 303 is attached to the drive shaft 339. Therefore, the projection 385 is stopped by the engaging member 363 at the position where it is removed from the engaging hole 305'. The projection 347 then comes into engagement with the swing lever 386 by the rotation of the cam plate 344 by the motor 342. The second swing lever 381 is returned together with the projection 385 through the connecting lever 387 against the tension of the spring 384. (Refer to FIGS. 38 and 39.)

On the other hand, when the type wheel 303 is not located at the foregoing position, the projection 385 of the second swing lever 381 is in contact with the surface of the boss 305 of the type wheel 303 by the tension of the spring 384. In this state, the type wheel 303 rotates once in the direction indicated by an arrow in FIG. 35 in association with the rotation of the drive shaft 339 due to the frictional engagement between the engaging member 363 of the elastic plate 364 and the back surface of the boss 305 of the type wheel 303 and due to the frictional engagement between the annular groove 360 of the drive shaft 339 and the elastic wire 307. During this rotation of the type wheel 303, when the engaging hole 305' of the type wheel 303 reaches the position of the projection 385 of the second swing lever 381, accordingly, the position which faces a predetermined position (home position) of the drive shaft 339, the second swing lever 381 is allowed to swing by the tension of the spring 384. Thus, the projection 385 comes into engagement with the engaging hole 305' and the type wheel 303 is temporarily stopped at that position. Next, when the drive shaft 339 rotates to this position and stops by the detection signal from the sensor 341, the engaging member 363 of the elastic plate 364 simultaneously collides with the projection 385 of the second swing lever 381 by the elastic force of the elastic plate 364. Thus, the second swing lever 381 is caused to swing against the urging force of the spring 384, thereby causing the projection 385 to be removed from the engaging hole 305' of the type wheel. Then, the engaging member 363 comes into engagement with the engaging hole 305', thereby allowing the type wheel to be attached to a predetermined position (home position) of the drive shaft 339. (FIGS. 34 to 37 show the states during those operations.) Subsequently, by rotating the cam plate 344 by the motor 342, the projection 347 comes into engagement with the swing lever 386 and the second swing lever 381 is returned as mentioned above. (FIGS. 38 and 39 show this state.)

Subsequently, when the motor 342 is rotated in the direction opposite to the foregoing direction, the respective components operate in the directions opposite to the foregoing directions, so that the drive shaft 339 is removed from the type wheel 303.

The above description will be summarized as follows. The carriage is mounted over the printer chassis so as to be movable in the lateral direction with respect to the platen attached to the chassis. The enclosing box is mounted on the carriage so as to be movable in the forward and backward directions. The daisy type wheel is rotatably enclosed in the cassette casing. A plurality of cassette casings each containing such a type wheel are enclosed in the enclosing box. The boss hole of selected one of the type wheels is moved together with its cassette casing to the position which faces the drive shaft of the drive motor attached to the carriage in response to the control signal from the CPU. Thereafter, the drive motor whose drive shaft is located at the predetermined position (home position) is moved together with the attaching base plate toward the selected type wheel by the control signal from the CPU. The drive shaft comes into engagement with the boss hole of this type wheel. When the base plate moves, the first swing lever attached to the carriage swings and the second swing lever also swings by the first swing lever. When the type wheel is located at the predetermined position (home position) in the cassette casing, the projection of the second swing lever comes into engagement with the engaging hole formed in the type wheel at the predetermined position (home position) from the front portion of the boss. The type wheel is temporarily stopped at that position. At the same time, the engaging member of the elastic plate arranged at the predetermined position (home position of the drive shaft) comes into engagement with the engaging hole from the back side of the boss of the type wheel in place of the projection of the second swing lever by the elastic force of the elastic plate. The type wheel can be automatically certainly attached to the predetermined position (home position) of the drive shaft in the state in which the type wheel is enclosed in the cassette casing at the predetermined position (home position).

On the other hand, when the type wheel is not located at the predetermined position (home position) in the cassette casing, the projection of the second swing lever comes into engagement with the front portion of the boss of the type wheel. The engaging member of the elastic plate elastically comes into engagement with the back portion of the boss of the type wheel. In this state, the type wheel is rotated once in a predetermined direction by the rotation of the drive shaft. During this rotation, the projection of the second swing lever comes into engagement with the engaging hole of the type wheel. The type wheel is temporarily stopped at that position. Subsequently, during the rotation of only the drive shaft, the engaging member of the elastic plate comes into engagement with the type wheel from the back surface of the boss of the type wheel in place of the projection of the second swing lever by the elastic force of the elastic plate. The type wheel enclosed in the cassette casing can be automatically certainly attached as it is to the predetermined position (home position) of the drive shaft in the state in which the type wheel is located at the predetermined position (home position). Since the predetermined positions (home positions) of the drive shaft and type wheel coincide, by selectively rotating the drive shaft, the position of the type wheel can be promptly selected. Therefore, this constitution is extremely convenient and can eliminate the troublesomeness of the operation to attach the type wheel to the drive shaft which has conventionally been manually performed. Further, since the type wheel is attached to the drive shaft in the state in which it is enclosed in the cassette casing, the type wheel will not be broken nor soiled, or the like. Therefore, this constitution has many excellent effects.

What is claimed is:

1. A printer of an automatic type wheel exchanging type, said printer having a platen for supporting one surface of a print sheet and carrying means guided so as to be reciprocated along said platen, said carrying means comprising:

a rotatable shaft;

drive means for detachably coupling said rotatable shaft to a rotational center of a type wheel having types in respective peripheral portions of a plurality of radially projected spokes and for exchanging the type wheel;

enclosing means for enclosing a plurality of type wheels;

attaching/detaching means for attaching a type wheel to said rotatable shaft and for detaching an attached type wheel at a detachable position;

moving means, including a motor and a rotary member which is rotated by the rotational force of said motor, for moving a type wheel in said enclosing means to the detachable position and for moving a type wheel located at the detachable position into the enclosing means, said attaching/detaching means and said moving means respectively made operative within one rotation of said rotary member, and said rotary member includes means for operating said moving means and thereafter said attaching/detaching means when said rotary member forwardly rotates and for operating said attaching/detaching means and thereafter said moving means when the rotary member rotates in reverse;

a hammer for pressing the type of a type wheel coupled to said rotatable shaft onto the print sheet; and type wheel exchanging means for exchanging a first type wheel coupled to said rotatable shaft by releasing the rotational center of the first said first type wheel from said rotatable shaft and engaging the rotational center of a second type wheel from said enclosing means with said rotatable shaft, and for returning the first type wheel to said enclosing means by said drive means.

2. A printer of an automatic type wheel exchanging type comprising:

drive means for detachably coupling at a detachable position a substantially disk-like type wheel having types in respective peripheral portions of a plurality of radially projected spokes, and for exchanging said type wheel;

a hammer for pressing the type of the type wheel coupled with said drive means onto a print sheet;

enclosing means for enclosing a plurality of the type wheels and stacking and receiving therein type wheels to be disposed in parallel;

moving means for lifting the type wheel in said enclosing means to a detachable position, and for lowering the type wheel at the detachable position into said enclosing means; and guide means for guiding said enclosing means in a direction substantially perpendicular to a direction in which the type wheel is lifted and lowered by said moving means, and wherein the type wheel to be lifted up by said moving means is selected by said enclosing means being guided in said substantially perpendicular direction, wherein said drive means and said enclosing means are arranged in a manner such that the type wheel in said enclosing means and the type wheel located at the detachable position overlap each other when the type wheel at the detachable position is detached, and wherein said drive means further comprises:

attaching/detaching means for attaching the type wheel to a rotatable shaft and for detaching the attached type wheel at a detachable position;

moving means for moving the type wheel in said enclosing means to the detachable position and for moving the type wheel located at the detachable position into the enclosing means; and means for driving both said attaching/detaching means and said moving means, said means for driving including a motor and a rotary member which is rotated by the rotational force of said motor, and wherein said attaching/detaching means and said moving means engage and are driven by said rotary member.

3. A printer according to claim 2, wherein said attaching/detaching means and said moving means are respectively made operative within one rotation of said rotary member, and said rotary member includes means for operating said moving means and thereafter the attaching/detaching means when said rotary member forwardly rotates, and for operating the attaching-/detaching means and thereafter the moving means when the rotary member reversely rotates.

4. A printer according to claim 3, further having detecting means for detecting a home position of said rotary member.

5. A printer according to claim 2, wherein said moving means has supporting portions for engaging and supporting a type wheel, and wherein said printer further comprises:

releasing means for releasing the engagement between said supporting portions and a type wheel after the attaching of a type wheel to said rotatable shaft by said attaching/detaching means, and for stopping the supporting portions at a position between said detachable position and an enclosing position of said enclosing means.

6. A printer according to claim 5, wherein said releasing means is made operative by further rotation of said rotary member.

7. A printer according to claim 6, wherein said rotary member is formed in a manner such that by rotating said rotary member once in a predetermined direction, said moving means operates, then said attaching/detaching means operates, and then said releasing means operates.

8. A printer for recording onto a recording medium, said printer having a platen and a carrier reciprocally movable along said platen, said carrier comprising:

an enclosing section containing therein a plurality of type wheels, each said type wheel holding characters and contained on the carrier;

a mounting section on which said type wheels are detachably mountable;

pick up means for picking up type wheels to be mounted on said mounting section from a plurality of type wheels contained on said enclosing section;

mounting means for mounting said type wheel picked up by said pick-up means onto said mounting section;

a hammer for pressing said characters of said character holding member to said recording medium;

attaching/detaching means for attaching a type wheel to said mounting section and for detaching an attached type wheel at a detachable position; and moving means, including a motor and a rotary member which is rotated by the rotational force of said motor, for moving a type wheel in said enclosing section to the detachable position and for moving a type wheel located at the detachable position into the enclosing section, said attaching/detaching means and said moving means respectively made operative within one rotation of said rotary member, and said rotary member includes means for operating said moving means and thereafter said attaching/detaching means when said rotary member forwardly rotates and for operating said attaching/detaching means and thereafter said moving means when the rotary member rotates in reverse.

9. A printer for recording onto a recording medium, said printer having a platen and a carrier reciprocally movable along said platen, said carrier comprising:

an enclosing section containing therein a plurality of type wheels, each said type wheels holding characters and contained on the carrier;

a mounting section on which said type wheels are detachably mountable;

transport means for selecting one of said type wheels from said enclosing section and moving said selected type wheel;

mounting means for mounting on said mounting section said type wheels moved by said transport and drive means; and a hammer for pressing said characters of said character holding member to said recording medium.

10. A printer according to claim 9, wherein said type wheel has a plurality of spokes each leading end of which has a character.

11. A printer according to claim 9, further comprising a motor wherein said transport means and said mounting means are driven by said motor.

12. A printer according to claim 9, wherein said transport means includes means for moving said type wheels in a vertical direction.

13. A printer according to claim 9, wherein said mounting means moves horizontally with respect to said type wheels for mounting said type wheels on said mounting section.

14. A printer according to claim 12, further comprising a motor wherein said transport means and said mounting means are driven by said motor.

15. A printer according to claim 13, further comprising a motor wherein said transport means and said mounting means are driven by said motor.

* * * * *

UNITED STATES PATENT AND TRADEMARK OFFICE

CERTIFICATE OF CORRECTION

PATENT NO. : 4,961,655

DATED : October 9, 1990

INVENTOR(S) : Hideo Saito, et al.

It is certified that error appears in the above-identified patent and that said Letters Patent is hereby corrected as shown below: ON THE TITLE PAGE:

[56] References cited:

Under "U.S. PATENT DOCUMENTS",
Insert: 4,480,932 11/1984 Willcox--.

Under "FOREIGN PATENT DOCUMENTS",
Insert:

| | | |
|---|---|---|
| DD 218039 | 1/85 | E. Germany |
| 58 131067 | 8/83 | Japan--. |

"33149 2/1894 Japan" should read
--33149 2/1984 Japan--.

Under "OTHER PUBLICATIONS",
"A.M. Robert et al.;" should read
--A.M. Roberti et al.;--.

COLUMN 1:

Line 5, "continuation-in-part" should read
--continuation--.

UNITED STATES PATENT AND TRADEMARK OFFICE

CERTIFICATE OF CORRECTION

PATENT NO. : 4,961,655

DATED : October 9, 1990

INVENTOR(S) : Hideo Saito, et al.

It is certified that error appears in the above-identified patent and that said Letters Patent is hereby corrected as shown below:

COLUMN 11:

Line 5, "a } -shape" should read --a } -shape--.

COLUMN 15:

Line 65, "84'.)" should read --84'.--.

Signed and Sealed this

Twenty-ninth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,961,655

DATED : October 9, 1990

INVENTOR(S) : Hideo Saito

It is certified that error appears in the above-identified patent and that said Letters Patent is hereby corrected as shown below:

COLUMN 15:

Line 65, "84'.) should read --84'.--.

COLUMN 26:

Line 14, "ters and contained on the carrier;" should read --ters;--.
Line 17, "pick up means" should read --pick-up means--.
Line 23, "charac-" should be deleted.
Line 24, "ter holding member" should read --type wheel--.
Line 49, "ters and contained on the carrier;" should read --ters;--.
Line 56, "type wheels" should read --type wheel--.
Line 58, "charac-" should be deleted.
Line 59 "ter holding member" should read --type wheel--.

Signed and Sealed this

Ninth Day of November, 1993

*Attest:*

*Attesting Officer*

BRUCE LEHMAN

*Commissioner of Patents and Trademarks*